US009236715B2

(12) United States Patent
Sakakura et al.

(10) Patent No.: US 9,236,715 B2
(45) Date of Patent: Jan. 12, 2016

(54) SPARK PLUG AND METHOD OF MANUFACTURING SPARK PLUG

(71) Applicant: NGK SPARK PLUG CO., LTD., Nagoya-shi, Aichi (JP)

(72) Inventors: Yasushi Sakakura, Aichi-ken (JP); Yukinobu Hasegawa, Aichi-ken (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/536,782

(22) Filed: Nov. 10, 2014

(65) Prior Publication Data

US 2015/0130345 A1 May 14, 2015

(30) Foreign Application Priority Data

Nov. 12, 2013 (JP) ..... 2013-234088
Aug. 4, 2014 (JP) ..... 2014-158425

(51) Int. Cl.
*H01T 13/32* (2006.01)
*H01T 21/02* (2006.01)

(52) U.S. Cl.
CPC ..... *H01T 13/32* (2013.01); *H01T 21/02* (2013.01)

(58) Field of Classification Search
CPC ..... H01T 13/08; H01T 21/02; H01T 13/32; H01T 13/20; H01T 13/36; H01T 13/54; B21H 3/04; F02B 2275/18; F02D 41/047; F02F 1/242; F02P 13/00
See application file for complete search history.

(56) References Cited

U.S. PATENT DOCUMENTS

| | | | | |
|---|---|---|---|---|
| 5,527,198 | A * | 6/1996 | Chiu et al. | 445/7 |
| 6,265,816 | B1 * | 7/2001 | Ito et al. | 313/141 |
| 6,642,638 | B2 * | 11/2003 | Ishiguro | 313/141 |
| 7,030,544 | B2 * | 4/2006 | Yamanaka | 313/141 |
| 7,049,733 | B2 * | 5/2006 | Lykowski et al. | 313/141 |
| 7,808,165 | B2 * | 10/2010 | Kowalski | 313/141 |
| 8,487,520 | B2 * | 7/2013 | Sakayanagi et al. | 313/142 |
| 2002/0003389 | A1 * | 1/2002 | Ishiguro | 313/141 |
| 2002/0130603 | A1 * | 9/2002 | Teramura et al. | 313/141 |
| 2002/0158559 | A1 * | 10/2002 | Sugiyama et al. | 313/141 |
| 2003/0181121 | A1 * | 9/2003 | Matsubara et al. | 445/7 |

(Continued)

FOREIGN PATENT DOCUMENTS

| | | | | |
|---|---|---|---|---|
| JP | 2006-185853 | A | 7/2006 | H01T 13/20 |
| JP | 4705129 | B2 | 3/2011 | H01T 13/20 |

(Continued)

OTHER PUBLICATIONS

Search Report issued in corresponding European Patent Application No. 14192499.3, dated Mar. 17, 2015.

(Continued)

*Primary Examiner* — Thomas A Hollweg
(74) *Attorney, Agent, or Firm* — Kusner & Jaffe

(57) ABSTRACT

A ground electrode comprised of a noble metal tip having an outer circumferential surface, a holder having an inner circumferential surface defining a through hole for the noble metal tip thereon, and a body to which the holder is joined. At least one of a) the inner circumferential surface of the holder which forms the through hole, and b) the outer circumferential surface of the noble metal tip which is disposed in the through hole, continuously reduces in diameter toward the forward side. A forward end surface of the noble metal tip is located on a forward side with respect to a forward end surface of the holder.

19 Claims, 12 Drawing Sheets

(56) References Cited

U.S. PATENT DOCUMENTS

| | | | | |
|---|---|---|---|---|
| 2006/0276097 | A1* | 12/2006 | Suzuki et al. | 445/7 |
| 2007/0132354 | A1* | 6/2007 | Scott et al. | 313/141 |
| 2008/0238282 | A1* | 10/2008 | Kato et al. | 313/142 |
| 2009/0160304 | A1* | 6/2009 | Kameda et al. | 313/141 |
| 2009/0289539 | A1 | 11/2009 | Sakakura | 313/141 |
| 2010/0264796 | A1* | 10/2010 | Musasa et al. | 313/11.5 |
| 2011/0133625 | A1* | 6/2011 | Sakayanagi et al. | 313/141 |

FOREIGN PATENT DOCUMENTS

| | | | | |
|---|---|---|---|---|
| JP | 2011-091064 | A | 5/2011 | H01T 13/20 |
| JP | 2013-143211 | A | 7/2013 | H01T 13/20 |

OTHER PUBLICATIONS

Japanese Office Action received in corresponding Japanese Patent Application No. 2014-158425, dated Sep. 29, 2015 (English translation provided).

* cited by examiner

SPARK PLUG AND METHOD OF MANUFACTURING SPARK PLUG

FIELD OF THE INVENTION

The present invention relates to a spark plug.

BACKGROUND OF THE INVENTION

Conventionally, a spark plug is used in an internal combustion engine. The spark plug has electrodes for forming a gap therebetween. For example, an electrode having a noble metal tip is used. In this connection, there is proposed a technique for welding a noble metal tip to a tip holder and welding the tip holder to a ground electrode.

In the case of using a tip holder for attaching a noble metal tip, as compared with the case of attaching a noble metal tip without use of a tip holder, the number of components increases; accordingly, appropriate attachment of the noble metal tip has not been easy. For example, a large burden has been involved in maintaining both of a dimensional tolerance of the noble metal tip and a dimensional tolerance of the tip holder within small ranges, respectively.

An object of the present invention is to facilitate implementation of appropriate attachment of a noble metal tip.

The present invention has been conceived to solve, at least partially, the above problem and can be embodied in the following application examples.

Application Example 1

In accordance with a first aspect of the present invention, there is provided a spark plug comprised of a ground electrode having a noble metal tip, a holder having a through hole for disposing therein the noble metal tip; and a body to which the holder is joined, and a center electrode for forming a gap in cooperation with the noble metal tip. In the spark plug, a forward side is a side toward the gap as viewed from the noble metal tip; an inside diameter Gf is an inside diameter of the holder at a forward end surface of the holder; an inside diameter Gr is an inside diameter of the holder at a rearward end surface of the holder; an outside diameter Tf is an outside diameter of the noble metal tip at a forward end surface of the noble metal tip; and an outside diameter Tr is an outside diameter of the noble metal tip at a rearward end surface of the noble metal tip. These parameters are in the following relations: the inside diameter Gf is less than the outside diameter Tr; the inside diameter Gf is less than the inside diameter Gr; and the outside diameter Tf is less than the outside diameter Tr. At least one of that inner circumferential surface of the holder which forms the through hole, and that outer circumferential surface of the noble metal tip which is disposed in the through hole, continuously reduces in diameter toward the forward side. The forward end surface of the noble metal tip is located on the forward side with respect to the forward end surface of the holder.

According to the above configuration, even when a large difference exists between a dimensional tolerance of the noble metal tip and that of the holder, appropriate attachment of the noble metal tip to the body can be easily implemented.

Application Example 2

In accordance with a second aspect of the present invention, there is provided a spark plug according to application example 1, wherein the inner circumferential surface of the holder has a first taper surface which continuously reduces in diameter toward the forward side, and the outer circumferential surface of the noble metal tip has a second taper surface which continuously reduces in diameter toward the forward side.

According the above configuration, the strength of attachment of the noble metal tip can be improved.

Application Example 3

In accordance with a third aspect of the present invention, there is provided a spark plug according to application example 2, wherein, in a section of the noble metal tip which contains a center axis of the noble metal tip, a difference dAg obtained by subtracting a first angle Ag1 from a second angle Ag2 is from −10 degrees to +10 degrees, where the first angle Ag1 is an acute angle between the first taper surface and the center axis, and the second angle Ag2 is an acute angle between the second taper surface and the center axis.

According to the above configuration, a positional shift of the noble metal tip in relation to the holder can be restrained.

Application Example 4

In accordance with a fourth aspect of the present invention, there is provided a spark plug according to any one of application examples 1 to 3, wherein the ground electrode further has a first fusion zone which joins at least the noble metal tip and the holder.

According to the above configuration, heat can be appropriately released to the metallic shell through the first fusion zone and the body.

Application Example 5

In accordance with a fifth aspect of the present invention, there is provided a spark plug according to application example 4, wherein the ground electrode has a plurality of the first fusion zones, and the first fusion zones are disposed at such positions as not to be directly opposite one another with respect to the center axis of the noble metal tip.

According to the above configuration, even in the case where the noble metal tip and the holder differ in thermal expansion coefficient, there can be restrained breakage of the noble metal tip or the holder which could otherwise result from variation of temperature.

Application Example 6

In accordance with a sixth aspect of the present invention, there is provided a spark plug according to application example 4 or 5 further comprising an insulator which holds the center electrode, and a metallic shell disposed radially around the insulator. In the spark plug, the body has a proximal end connected to the metallic shell, and at least one first fusion zone is located toward the proximal end with respect to the center axis of the noble metal tip.

According to the above configuration, an increase in temperature of the noble metal tip can be restrained.

Application Example 7

In accordance with a seventh aspect of the present invention, there is provided a spark plug according to application example 6, wherein, in a view from a direction parallel to the center axis of the noble metal tip, at least one first fusion zone is superposed on a longitudinal axis of the body while being located toward the proximal end with respect to the center axis.

According to the above configuration, an increase in temperature of the noble metal tip can be restrained.

Application Example 8

In accordance with an eight aspect of the present invention, there is provided a spark plug according to any one of application examples 4 to 7, wherein the first fusion zone has an exposed surface which is exposed at a surface of the body.

According to the above configuration, the first fusion zone can be easily formed.

Application Example 9

In accordance with a ninth aspect of the present invention, there is provided a spark plug according to any one of application examples 1 to 8, wherein the ground electrode has a second fusion zone which joins the holder and the body, and the second fusion zone is away from the noble metal tip.

According to the above configuration, mixing of a noble metal component into the second fusion zone can be restrained.

Application Example 10

In accordance with a tenth aspect of the present invention, there is provided a spark plug according to application example 9, wherein the ground electrode further has a first fusion zone which joins at least the noble metal tip and the holder; the body has a proximal end connected to the metallic shell; the entire first fusion zone is located toward the proximal end with respect to the center axis of the noble metal tip; and at least a portion of the second fusion zone is located opposite the proximal end with respect to the center axis of the noble metal tip.

According to the above configuration, even in the case where the noble metal tip is lower in thermal expansion coefficient than the body, there can be restrained breakage of the noble metal tip which could otherwise result from an increase in temperature.

Application Example 11

In accordance with an eleventh aspect of the present invention, there is provided a spark plug according to application example 9 or 10, wherein the noble metal tip has a protrusion which is connected to a rearward end of a portion disposed within the through hole and which protrudes radially outward from an edge of the through hole at the rearward end surface of the holder.

According to the above configuration, by virtue of the protrusion of the noble metal tip in contact with the rearward end surface of the holder, a positional shift of the noble metal tip toward the forward side is restrained, whereby appropriate attachment of the noble metal tip can be easily implemented.

Application Example 12

In accordance with a twelfth aspect of the present invention, there is provided a spark plug according to application example 11, wherein the protrusion has a thickness of 0.2 mm or more along a direction parallel to the center axis of the noble metal tip.

According to the above configuration, breakage of the protrusion is restrained, whereby appropriate attachment of the noble metal tip can be easily implemented.

Application Example 13

In accordance with a thirteenth aspect of the present invention, there is provided a spark plug according to application example 11 or 12, wherein a length, along a radial direction of a circle centered on the center axis of the noble metal tip, between a rearward end of an outer circumferential surface of a portion of the noble metal tip disposed within the through hole and an outer circumferential end of the protrusion is from 0.05 mm to 0.25 mm.

According to the above configuration, breakage of the protrusion and a positional shift of the noble metal tip can be restrained, whereby appropriate attachment of the noble metal tip can be easily implemented.

Application Example 14

In accordance with a fourteenth aspect of the present invention, there is provided a method of manufacturing a spark plug according to any one of application examples 1 to 13 comprising a disposition step of disposing the noble metal tip in the through hole of the holder, and a step of applying a load to the holder from a radial direction of the holder after the disposition step.

The present invention can be implemented in various forms; for example, a spark plug, an internal combustion engine in which spark plugs are mounted, and a method of manufacturing a spark plug.

DETAILED DESCRIPTION OF THE PREFERRED EMBODIMENTS

A. First Embodiment

A-1. Configuration of Spark Plug

Figure 1:
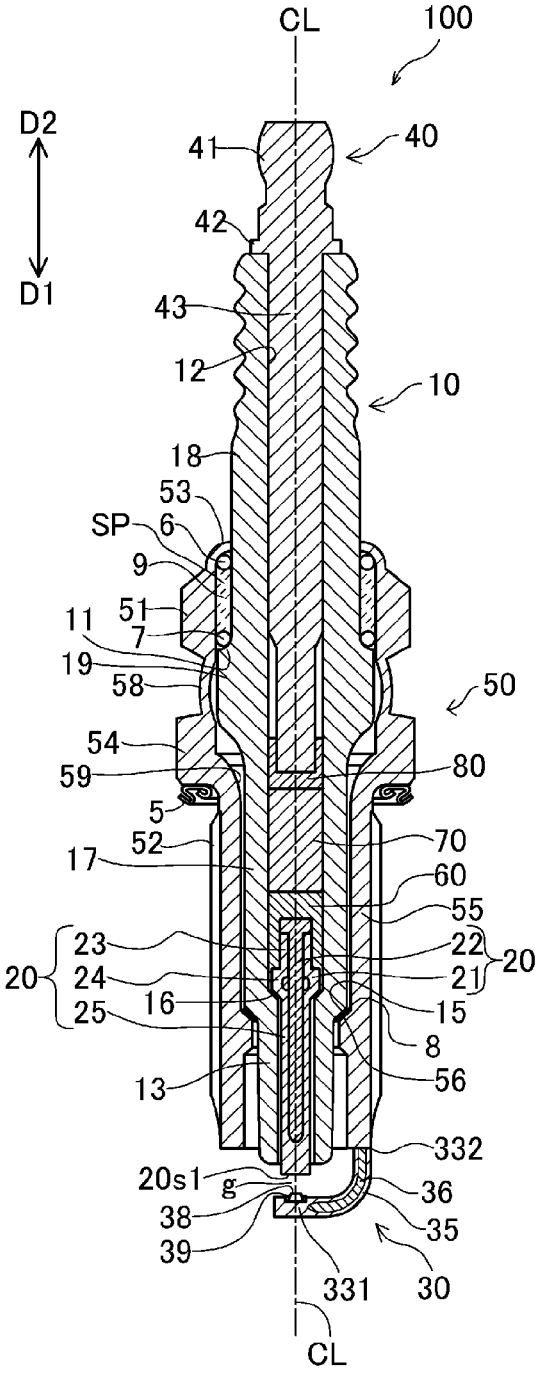
FIG. 1 is a sectional view of an example spark plug according to a first embodiment of the present invention.

FIG. 1 is a sectional view of an example spark plug according to a first embodiment of the present invention. An illustrated line C1 indicates the center axis of a spark plug 100. The illustrated section is a section which contains the center axis CL. Hereinafter, the center axis CL may also be called the "axial line CL," and a direction in parallel to the center axis CL may also be called the "axial direction." Regarding a direction in parallel to the center axis CL in FIG. 1, a downward direction may also be called the first direction D1, and an upward direction may also be called the second direction D2. The first direction D1 is a direction directed from a metal terminal member 40 to electrodes 20 and 30, which will be described later. A radial direction of a circle centered on the center axis CL may also be called the "radial direction," and a circumferential direction of a circle centered on the center axis CL may also be called the "circumferential direction."

The spark plug 100 includes an insulator 10 (hereinafter, may also be called the "ceramic insulator 10"), a center electrode 20, a ground electrode 30, the metal terminal member 40, a metallic shell 50, an electrically conductive first seal 60, a resistor 70, an electrically conductive second seal 80, a first packing 8, talc 9, a second packing 6, and a third packing 7.

The insulator 10 is a substantially cylindrical member having a through hole 12 (hereinafter, may also be called the "axial hole 12") which extends therethrough along the center axis CL. The insulator 10 is formed through firing of alumina (other electrically insulating materials can be employed). The insulator 10 has a leg portion 13, a first outside-diameter reducing portion 15, a first trunk portion 17, a collar portion 19, a second outside-diameter reducing portion 11, and a second trunk portion 18, which are arranged in this order from the first direction D1 side toward the second direction D2 side. The first outside-diameter reducing portion 15 gradually reduces in outside diameter from the second direction D2 side toward the first direction D1 side. The insulator 10 has an inside-diameter reducing portion 16 formed in the vicinity of the first outside-diameter reducing portion 15 (the first trunk portion 17 in FIG. 1), and the inside-diameter reducing portion 16 gradually reduces in inside diameter from the second direction D2 side toward the first direction D1 side. The second outside-diameter reducing portion 11 gradually reduces in outside diameter from the first direction D1 side toward the second direction D2 side.

A rodlike center electrode 20 is inserted in the axial hole 12 of the insulator 10 on the side toward the first direction D1. The center electrode 20 has a leg portion 25, a collar portion 24, and a head portion 23, which are arranged in this order from the first direction D1 side toward the second direction D2 side. The leg portion 25 protrudes from the axial hole 12 of the insulator 10 in the first direction D1. Except for the protruding portion of the leg portion 25, the center electrode 20 is disposed within the axial hole 12. The surface of the collar portion 24 oriented in the first direction D1 is supported by the inside-diameter reducing portion 16. Also, the center electrode 20 has an electrode base metal 21, and a core 22 embedded in the electrode base metal 21. The electrode base metal 21 is, for example, an alloy (e.g., INCONEL (registered trademark)) which contains nickel (Ni) as a main component. The "main component" means a component having the highest content (the same also applies to the following description). The content employed herein is expressed in percent by weight. The core 22 is formed of a material (e.g., an alloy which contains copper) whose thermal conductivity is higher than that of the electrode base metal 21.

The metal terminal member 40 is inserted in the axial hole 12 of the insulator on the side toward the second direction D2. The metal terminal member 40 is formed of an electrically conductive material (e.g., metal such as low carbon steel). The metal terminal member 40 has a cap attachment portion 41, a collar portion 42, and a leg portion 43, which are arranged in this order from the second direction D2 side toward the first direction D1 side. The cap attachment portion 41 protrudes from the axial hole 12 of the insulator 10 in the second direction D2. The leg portion 43 is inserted in the axial hole 12 of the insulator 10.

In the axial hole 12 of the insulator 10, the circular columnar resistor 70 is disposed between the metal terminal member 40 and the center electrode 20 for restraining electrical noise. The electrically conductive first seal 60 is disposed between the resistor 70 and the center electrode 20, and the electrically conductive second seal 80 is disposed between the resistor 70 and the metal terminal member 40. The center electrode 20 and the metal terminal member 40 are electrically connected to each other through the resistor 70 and the seals 60 and 80. Use of the seals 60 and 80 stabilizes contact resistance between the stacked members 20, 60, 70, 80, and 40 and stabilizes electrical resistance between the center electrode 20 and the metal terminal member 40. The resistor 70 is formed by use of, for example, glass powder (e.g., $B_2O_3$—$SiO_2$ glass) as a main component, ceramic powder (e.g., $TiO_2$), and an electrically conductive material (e.g., Mg). The seals 60 and 80 are formed by use of, for example, glass powder used to form the resistor 70, and metal powder (e.g., Cu).

The metallic shell 50 is a substantially cylindrical member having a through hole 59 which extends therethrough along the center axis CL. The metallic shell 50 is formed of low carbon steel (other electrically conductive materials (e.g., metal) can be employed). The insulator 10 is inserted through the through hole 59 of the metallic shell 50. The metallic shell 50 is fixed to the insulator 10 while being disposed radially around the insulator 10. An end portion of the insulator 10 located on the side toward the first direction D1 (in the present embodiment, a portion of the leg portion 13 located on the side toward the first direction D1) protrudes from the through hole 59 of the metallic shell 50 in the first direction D1. An end portion of the insulator 10 located on the side toward the second direction D2 (in the present embodiment, a portion of the second trunk portion 18 located on the side toward the second direction D2) protrudes from the through hole 59 of the metallic shell 50 in the second direction D2.

The metallic shell 50 has a trunk portion 55, a seat portion 54, a deformed portion 58, a tool engagement portion 51, and a crimped portion 53, which are arranged in this order from the first direction D1 side toward the second direction D2 side. The seat portion 54 assumes the form of a collar. The trunk portion 55 has a threaded portion 52 which is formed on its outer circumferential surface and is to be threadingly engaged with a mounting hole of an internal combustion engine (e.g., a gasoline engine). An annular gasket 5 formed through bending of a metal sheet is fitted between the seat portion 54 and the threaded portion 52.

The metallic shell 50 has an inside-diameter reducing portion 56 located on the side toward the first direction D1 with respect to the deformed portion 58. The inside-diameter reducing portion 56 gradually reduces in inside diameter from the second direction D2 side toward the first direction D1 side. The first packing 8 is held between the inside-diameter reducing portion 56 of the metallic shell 50 and the first outside-diameter reducing portion 15 of the insulator 10. The first packing 8 is an O-ring of iron (other materials (e.g., metal such as copper) can be employed).

The tool engagement portion 51 has a shape (e.g., hexagonal prism) corresponding to a spark plug wrench to be engaged therewith. The crimped portion 53 is provided on the side toward the second direction D2 with respect to the tool engagement portion 51. The crimped portion 53 is disposed on the side toward the second direction D2 with respect to the second outside-diameter reducing portion 11 and forms an end of the metallic shell 50 located toward the second direction D2. The crimped portion 53 is bent radially inward.

In a portion of the metallic shell 50 located on the side toward the second direction D2, an annular space SP is formed between the inner circumferential surface of the metallic shell 50 and the outer circumferential surface of the insulator 10. In the present embodiment, the space SP is defined by the crimped portion 53 and the tool engagement portion 51 of the metallic shell 50 and the second outside-diameter reducing portion 11 and the second trunk portion 18 of the insulator 10. The second packing 6 is disposed within the space SP on the side toward the second direction D2. The third packing 7 is disposed within the space SP on the side toward the first direction D1. In the present embodiment, the packings 6 and 7 are C-rings of iron (other materials can be employed). The space SP is filled with powder of the talc 9 between the two packings 6 and 7.

In manufacture of the spark plug 100, a predecessor of the crimped portion 53 is bent inward for crimping. Accordingly, the crimped portion 53 is pressed in the first direction D1. Thus, a predecessor of the deformed portion 58 is deformed, whereby the insulator 10 is pressed in the first direction D1 within the metallic shell 50 through the packings 6 and 7 and the talc 9. The first packing 8 is pressed between the first outside-diameter reducing portion 15 and the inside-diameter reducing portion 56, thereby providing a seal between the metallic shell 50 and the insulator 10. Thus, there is restrained outward leakage of gas from inside a combustion chamber of an internal combustion engine through a gap between the metallic shell 50 and the insulator 10. Also, the metallic shell 50 is fixed to the insulator 10.

The ground electrode 30 is joined to an end of the metallic shell 50 located on the side toward the first direction D1. The ground electrode 30 has a body 33, a noble metal tip 38, and a holder 39. In the present embodiment, the body 33 is a bar-like member. One end (hereinafter, called the "proximal end 332") of the body 33 is joined (e.g., laser-welded) to an end of the metallic shell 50 located on the side toward the first direction D1 in an electrically conductive manner. The body 33 extends from the metallic shell 50 in the first direction D1 and is bent toward the center axis CL to reach a distal end portion 331. The noble metal tip 38 and the holder 39 are fixed on that surface of the distal end portion 331 which is oriented in the second direction D2. The noble metal tip 38 forms a gap g in cooperation with a distal end surface **20*s*1 (surface 20*s*1 oriented in the first direction D1) of the center electrode 20. The body 33 has a base metal 35 which forms the surface of the body 33, and a core 36 embedded in the base metal 35. The base metal 35 is, for example, Ni or an alloy (e.g., INCONEL) which contains Ni as a main component. The core 36 is formed of a material (e.g., pure copper) which is higher in thermal conductivity than the base metal 35**.

Figure 2:
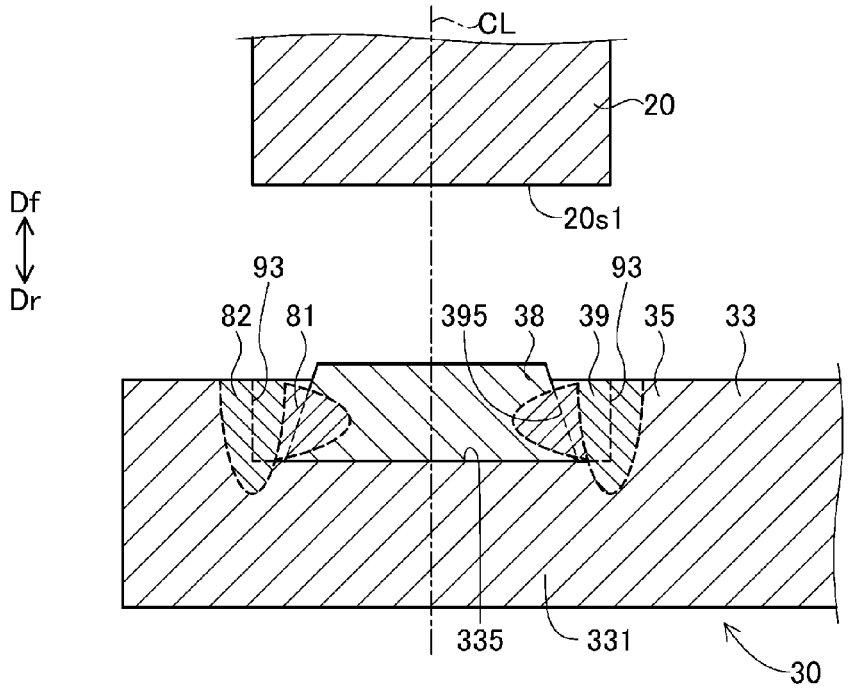
FIG. 2 is a fragmentary sectional view showing, on an enlarged scale, a distal end portion 331 and its vicinity of a ground electrode 30.
Figure 3:
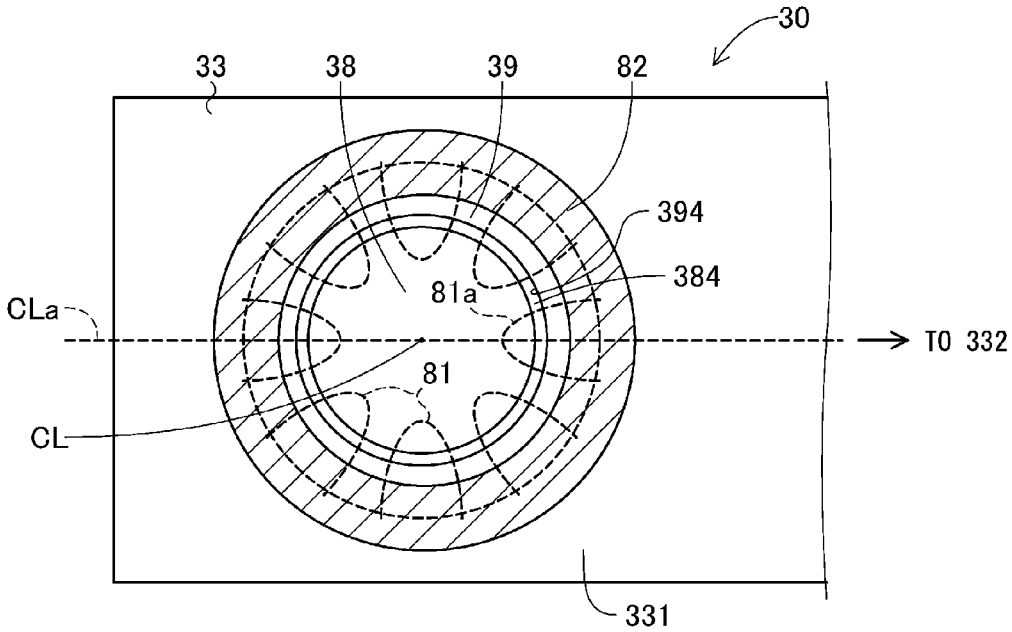
FIG. 3 is a schematic view of the distal end portion 331 of the ground electrode 30.

FIG. 2 is a fragmentary sectional view showing, on an enlarged scale, the distal end portion 331 and its vicinity of the ground electrode 30 of FIG. 1. FIG. 3 is a schematic view of the distal end portion 331 and its vicinity of the ground electrode 30 as viewed in the first direction D1 from the side toward the second direction D2. As illustrated, a recess 335 depressed in the first direction D1 is formed in the surface of the body 33 at a position which faces the distal end surface **20*s*1 of the center electrode 20. The recess 335 has a substantially circular columnar shape centered on the center axis CL. The recess 335 is formed in the base metal 35 of the body 33. The recess 335 fixedly accommodates therein the noble metal tip 38 which protrudes toward the center electrode 20, and the holder 39 which surrounds the noble metal tip 38**.

The noble metal tip 38 has a substantially truncated cone shape centered on the center axis CL. The outside diameter of the noble metal tip 38 gradually reduces toward the center electrode 20. The noble metal tip 38 is formed of an alloy which contains a noble metal, such as platinum (Pt), iridium (Ir), or rhodium (Rh), as a main component. Among noble metals, Ir has a high melting point and exhibits excellent resistance to spark-induced erosion. Therefore, preferably, the noble metal tip 38 is formed of Ir or an alloy which contains Ir as a main component. Ir is lower in thermal conductivity than other noble metals such as Pt. However, as will be described later, an increase in temperature of the noble metal tip 38 can be restrained. Therefore, even in the case where the noble metal tip 38 contains Ir, oxidation of the noble metal tip 38 can be restrained.

The holder 39 has an annular shape having a through hole 395 extending along the center axis CL. The external shape of the holder 39 is substantially identical with the shape formed by the inner wall surface of the recess 335. The shape of the through hole 395 is substantially identical with the shape of that portion of the noble metal tip 38 which remains after removal of a portion protruding from the body 33. That is, similar to the outside diameter of the noble metal tip 38, the inside diameter of the holder 39 gradually reduces toward the center electrode 20. The holder 39 is formed of Ni or an alloy which contains Ni as a main component. Preferably, the holder 39 is formed of the same material as the base metal 35 of the body 33. Use of the same material improves joining strength between the holder 39 and the base metal 35.

The noble metal tip 38 is disposed in the through hole 395 of the holder 39. The noble metal tip 38 is joined to the holder 39 by laser welding. Eight first fusion zones 81 shown in FIG. 3 are where materials of the noble metal tip 38 and the holder 39 are fused together in welding the noble metal tip 38 and the holder 39. The noble metal tip 38 and the holder 39 are fixed to each other through the first fusion zones 81. As will be described later, the first fusion zones 81 extend from the outer circumferential surface of the holder 39 to the interior of the noble metal tip 38. As shown in FIG. 3, the eight first fusion zones 81 are disposed at substantially equal intervals along the circumferential direction.

The holder 39 is joined to the body 33 by laser welding. An illustrated second fusion zone 82 is where materials of the holder 39 and the body 33 are fused together in welding the holder 39 and the body 33. In FIG. 3, the second fusion zone 82 is hatched. The holder 39 is fixed to the body 33 through the second fusion zone 82. As shown in FIG. 2, the second fusion zone 82 extends in the first direction D1 from the surface oriented in the second direction D2 along a boundary 93 between the outer circumferential surface of the holder 39 and the inner circumferential surface of the recess 335. Also, as shown in FIG. 3, the second fusion zone 82 is formed along the entire circumference of a circle centered on the center axis CL.

The first fusion zones 81 contain components of the noble metal tip 38 and components of the holder 39. A fusion zone which contains a noble metal is more likely to be oxidized as compared with a fusion zone which contains no noble metal. In the first embodiment shown in FIGS. 2 and 3, the entire outer circumferential surface of the holder 39 is accommodated within the recess 335. Accordingly, the first fusion zones 81 which contain a noble metal are accommodated within the recess 335 and thus are not exposed to the ambient atmosphere. Therefore, oxidation of the first fusion zones 81 can be restrained.

The second fusion zone 82 which joins the holder 39 and the body 33 is away from the noble metal tip 38. Thus, a noble metal component of the noble metal tip 38 is restrained from being mixed into the second fusion zone 82. As a result, oxidation of the second fusion zone 82 can be restrained.

A-2. Method of Manufacturing Spark Plug

Figure 4:
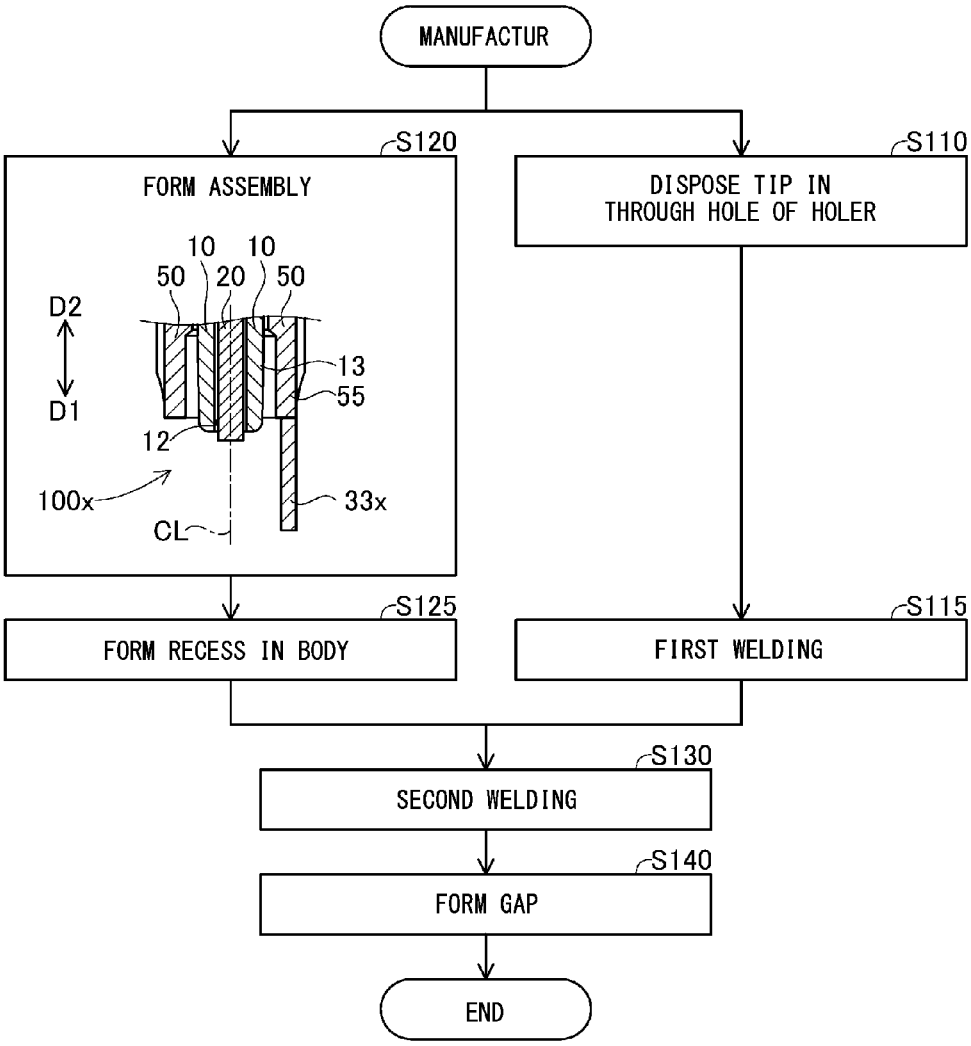
FIG. 4 is a flowchart showing an example method of manufacturing a spark plug.
Figure 5:
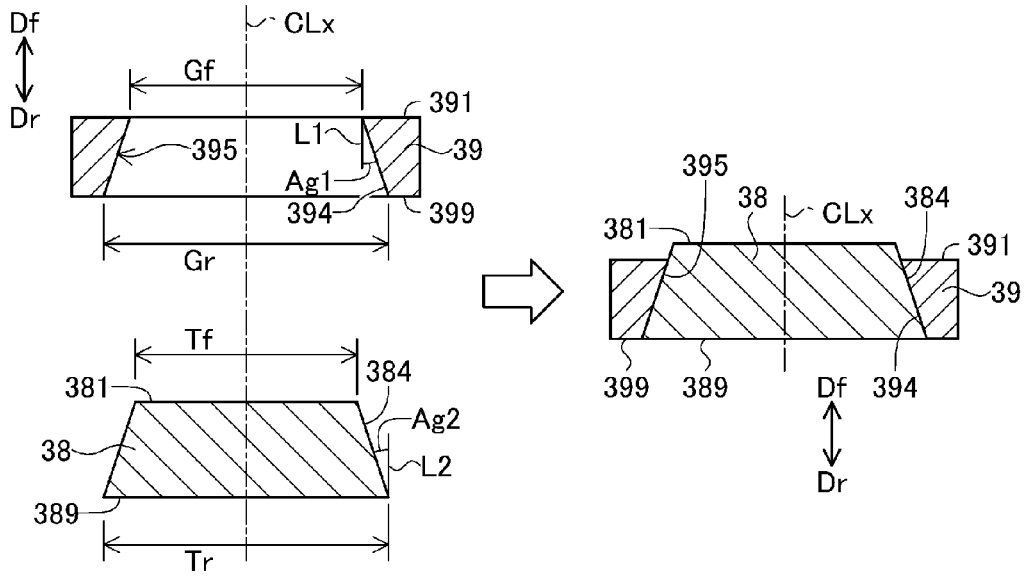
FIG. 5 is an explanatory view for explaining the disposition of a noble metal tip 38.

FIG. 4 is a flowchart showing an example method of manufacturing a spark plug. In step S110, the noble metal tip 38 is disposed within the through hole 395 of the holder 39. FIG. 5 is an explanatory view for explaining the disposition of the noble metal tip 38. FIG. 5 shows sections which contain the center axis CLx of the noble metal tip 38. FIG. 5 shows, at the left, the noble metal tip 38 and the holder 39 which are arranged coaxially. FIG. 5 shows, at the right, a condition in which the noble metal tip 38 is disposed within the through hole 395. Regarding directions Df and Dr in parallel with the center axis CLx of the noble metal tip 38, the direction Df directed toward the gap g (FIG. 1) as viewed from the noble metal tip 38 is called the forward direction Df, and the direction Dr opposite the forward direction Df is called the rearward direction Dr. The forward direction Df is a direction directed from an end surface 389 having a large outside diameter toward an end surface 381 having a small outside diameter. In the completed spark plug 100 shown in FIG. 1, the forward direction Df is the second direction D2. Hereinafter, the end surface 381 of the noble metal tip 38 oriented in the forward direction Df is called the forward end surface 381. The end surface 389 of the noble metal tip 38 oriented in the rearward direction Dr is called the rearward end surface 389. An end surface 391 of the holder 39 oriented in the forward direction Df is called the forward end surface 391. An end surface 399 of the holder 39 oriented in the rearward direction Dr is called the rearward end surface 399.

FIG. 5 shows outside diameters Tf and Tr and inside diameters Gf and Gr. The first outside diameter Tf is of the forward end surface 381 of the noble metal tip 38. The second outside diameter Tr is of the rearward end surface 389 of the noble metal tip 38. The first inside diameter Gf is of the forward end surface 391 of the holder 39. The second inside diameter Gr is of the rearward end surface 399 of the holder 39. In the present embodiment, the following three relations hold:

1) first inside diameter Gf<second outside diameter Tr;
2) first inside diameter Gf<second inside diameter Gr; and
3) first outside diameter Tf<second outside diameter Tr.

In the present embodiment, the second outside diameter Tr of the noble metal tip 38 is substantially equal to the second inside diameter Gr of the holder 39.

An inner circumferential surface 394 of the holder 39 assumes the form of a taper surface (hereinafter, may also be called the "first taper surface 394") which continuously reduces in diameter in the forward direction Df. In the present embodiment, in a section which contains the center axis CLx, the first taper surface 394 is represented by substantially straight lines. An outer circumferential surface 384 of the noble metal tip 38 assumes the form of a taper surface (hereinafter, may also be called the "second taper surface 384") which continuously reduces in diameter in the forward direction Df. In the present embodiment, in the section which contains the center axis CLx, the second taper surface 384 is represented by substantially straight lines.

FIG. 5 shows auxiliary lines L1 and L2 and angles Ag1 and Ag2. The first auxiliary line L1 is a straight line parallel to the center axis CLx and intersects with the first taper surface 394 of the holder 39. The first angle Ag1 is an acute angle between the first taper surface 394 and the first auxiliary line L1 (i.e., the center axis CLx). The second auxiliary line L2 a straight line parallel to the center axis CLx and intersects with the second taper surface 384 of the noble metal tip 38. The second angle Ag2 is an acute angle between the second taper surface 384 and the second auxiliary line L2 (i.e., the center axis CLx). In the present embodiment, the first angle Ag1 is substantially equal to the second angle Ag2.

As shown at the right in FIG. 5, in the present embodiment, in a condition in which the noble metal tip 38 is disposed in the through hole 395 of the holder 39, the rearward end surface 389 of the noble metal tip 38 is substantially flush with the rearward end surface 399 of the holder 39. At least a portion of the outer circumferential surface 384 of the noble metal tip 38 is in contact with the inner circumferential surface 394 of the holder 39.

Figure 6:
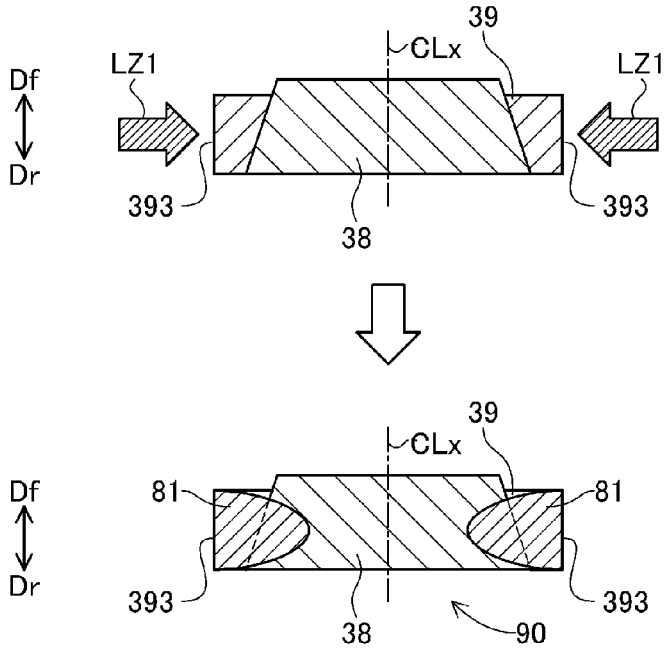
FIG. 6 is an explanatory view for explaining welding.

In the next step S115 of FIG. 4, the noble metal tip 38 and the holder 39 are welded (hereinafter, welding in step S115 may also be called the "first welding"). FIG. 6 is an explanatory view for explaining welding. FIG. 6 shows a section of the noble metal tip 38 and the holder 39 which contains the center axis CLx. FIG. 5 shows, at the top, a condition during welding and, at the bottom, a condition after welding. The arrows LZ1 in FIG. 6 schematically show laser beams. The laser beam LZ1 is radiated onto the outer circumferential surface 393 of the holder 39. The laser beam LZ1 is radiated in a direction from the outer circumferential surface 393 toward the center axis CLx. Such radiation of the laser beam LZ1 forms the first fusion zone 81 extending from the outer circumferential surface 393 of the holder 39 into the noble metal tip 38. The laser beam LZ1 is radiated at eight positions located at substantially equal intervals along the circumferential direction so as to form the eight first fusion zones 81 (FIG. 3). Hereinafter, a member 90 composed of the noble metal tip 38 and the holder 39 is called the "electrode tip 90."

Next, steps S120 and S125 of FIG. 4 will be described. Steps S120 and S125 are performed independent of steps S110 and S115. In step S120, an assembly is formed. The assembly is an article in a process of manufacturing the spark plug 100 shown in FIG. 1 before bending of the body 33 of the ground electrode 30 and joining the electrode tip 90 onto the body 33. The frame showing step S120 of FIG. 4 contains a fragmentary sectional view showing the center electrode 20 and its vicinity of an assembly 100*x*. The assembly 100*x* has the insulator 10, the metallic shell 50 fixed to the insulator 10, and the center electrode 20 inserted into the through hole 12 of the insulator 10. Also, a straight member 33*x* (hereinafter, called the "body 33*x*",) which is to become the body 33 through bending, is joined to the metallic shell 50. The view omits illustration of the base metal 35 and the core 36 of the body 33*x*. Other views to be mentioned later may omit illustration of the base metal 35 and the core 36. The assembly can be formed by any one of publicly known methods; thus, the detailed description of the method is omitted.

Figure 7:
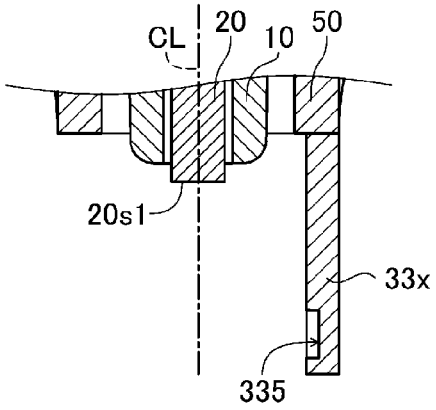
FIG. 7 is an explanatory view for explaining a recess 335.

In the next step S125, the recess 335 is formed in the body 33*x* of the ground electrode 30. FIG. 7 is an explanatory view for explaining the recess 335. FIG. 7 is a fragmentary sectional view showing the body 33*x* and its vicinity of the assembly 100*x*. The illustrated section is a section of the assembly 100*x* which contains the center axis CL. As shown in FIG. 7, the recess 335 is formed in the body 33*x* to be bent. The recess 335 is formed, for example, by use of a cutting tool such as a drill. Preferably, the position of the recess 335 on the body 33*x* is determined so as to correspond to the position of the distal end surface 20*s*1 of the center electrode 20. Through employment of such positioning, even when any positional deviation arises between the metallic shell 50 and the center electrode 20, an appropriate gap g can be formed.

Figure 8:
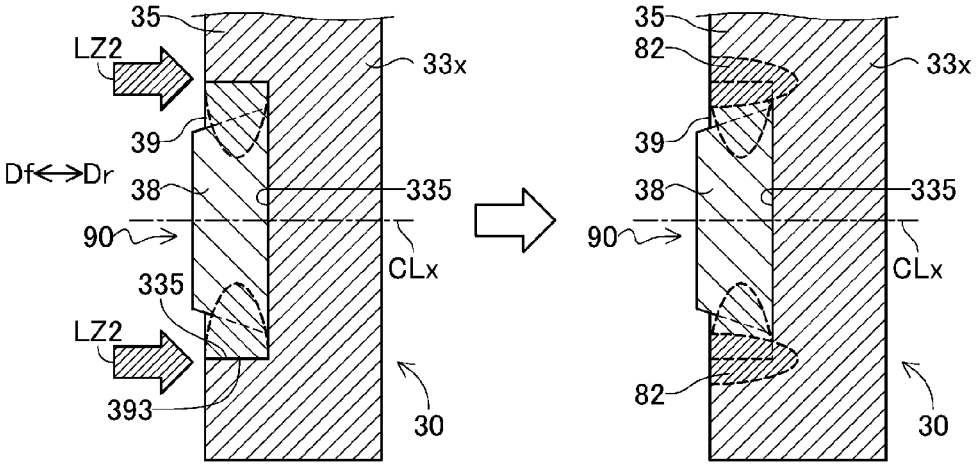
FIG. 8 is an explanatory view for explaining welding.

In the next step S130 of FIG. 4, the electrode tip 90 is welded into the recess 335 (hereinafter, welding in step S130 may also be called the "second welding"). FIG. 8 is an explanatory view for explaining welding. FIG. 4 shows a fragmentary section of the recess 335 and its vicinity (a fragmentary section of the noble metal tip 38 which contains the center axis CLx). FIG. 8 shows, at the left, a condition during welding and, at the right, a condition after welding. The arrows LZ2 in FIG. 8 schematically show laser beams. First, the electrode tip 90 is disposed in the recess 335. Then, the laser beam LZ2 is radiated onto the boundary between the inner circumferential surface of the recess 335 and the outer circumferential surface 393 of the holder 39 in the rearward direction Dr from the side toward the forward direction Df. Such radiation of the laser beam LZ2 forms the second fusion zone 82 which joins the inner circumferential surface of the recess 335 and the outer circumferential surface 393 of the holder 39 (i.e., the body 33*x* (herein, the base metal 35) and the holder 39). As mentioned above with reference to FIG. 3, the laser beam LZ2 is radiated along the entire circumference of the boundary between the inner circumferential surface of the recess 335 and the outer circumferential surface 393 of the holder 39.

Figure 9:
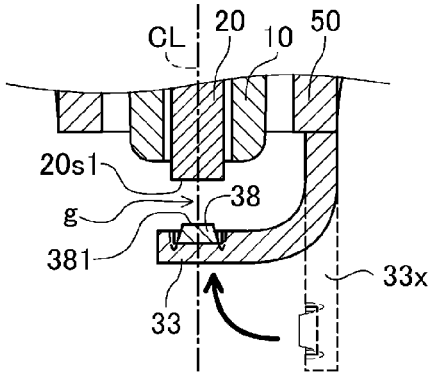
FIG. 9 is an explanatory view for explaining a process of bending a body 33*x*.

In the next step S140 of FIG. 4, the body 33*x* is bent to form the gap g. FIG. 9 is an explanatory view for explaining a process of bending the body 33*x*. FIG. 9 shows a fragmentary section of the body 33*x* and its vicinity (a fragmentary section which contains the center axis CL). As shown in FIG. 9, the body 33*x* is bent toward the center electrode 20. This bending work forms the gap g between the distal end surface 20*s*1 of the center electrode 20 and the forward end surface 381 of the noble metal tip 38. The body 33*x* is bent in such a manner as to form the gap g having a predetermined size. Thus, the spark plug 100 is completed.

As mentioned above, in the first embodiment, the first inside diameter Gf of the holder 39 (FIG. 5) is less than the second outside diameter Tr of the noble metal tip 38. Therefore, this dimensional relation restrains detachment in the forward direction Df of the noble metal tip 38 from the through hole 395 of the holder 39. Also, an end of the through hole 395 (FIG. 8) on the rearward direction Dr side is closed by the body 33. Therefore, detachment of the noble metal tip 38 from the ground electrode 30 can be restrained.

Also, the inner circumferential surface 394 of the holder 39 (FIG. 5) assumes the form of the first taper surface 394 which continuously reduces in diameter in the forward direction Df. Furthermore, the outer circumferential surface 384 of the noble metal tip 38 assumes the form of the second taper surface 384 which continuously reduces in diameter in the forward direction Df. Therefore, even in the case where at least one of the outside diameter of the noble metal tip 38 and the inside diameter of the holder 39 is large in tolerance, the noble metal tip 38 can be easily fitted into the through hole 395 of the holder 39. Also, the outer circumferential surface 384 of the noble metal tip 38 can be easily brought into contact with the inner circumferential surface 394 of the holder 39. As a result, joining strength between the noble metal tip 38 and the holder 39 can be improved. Thus, the noble metal tip 38 can be appropriately fixed to the body 33.

Also, as shown in FIG. 5, the forward end surface 381 of the noble metal tip 38 is located on the side toward the forward direction Df with respect to the forward end surface 391 of the holder 39. Therefore, there can be restrained the occurrence of discharge at other than the forward end surface 381 of the noble metal tip 38 (e.g., at the forward end surface 391 of the holder 39).

Also, the ground electrode 30 has the first fusion zones 81 which join the noble metal tip 38 and the holder 39. Therefore, joining strength between the noble metal tip 38 and the holder 39 can be easily improved.

Also, as shown in FIG. 3, a plurality of the first fusion zones 81 include first fusion zones 81*a* which are located toward the proximal end 332 with respect to the center axis of the noble metal tip 38 (in FIG. 3, the center axis CL). Such first fusion zones 81*a* can restrain an increase in temperature of the noble metal tip 38 as described below. When an internal combustion engine is operated, the temperature of the noble metal tip 38 increases. The holder 39 can release heat from the noble metal tip 38 to the body 33 through the first fusion zones 81*a*. The body 33 can release heat to the metallic shell 50 through the proximal end 332. Thus, in the case where the first fusion zones 81*a* are located near the proximal end 332; i.e., the first fusion zones 81*a* are located toward the proximal end 332 with respect to the center axis of the noble metal tip 38, the first fusion zones 81*a* can appropriately cool the noble metal tip 38. As a result, erosion of the noble metal tip 38 can be restrained.

Also, as shown in FIG. 3, in a view from a direction parallel to the center axis (in FIG. 3, the center axis CL) of the noble metal tip 38, at least one first fusion zone 81*a* is superposed on a longitudinal axis CLa of the body 33 while being located toward the proximal end 332 with respect to the center axis of the noble metal tip 38. That is, the first fusion zone 81*a* is disposed at a position closest to the proximal end 332 in a contact region between the outer circumferential surface 384 of the noble metal tip 38 and the inner circumferential surface 394 of the holder 39. Therefore, the first fusion zones 81*a* can appropriately cool the noble metal tip 38. As a result, erosion of the noble metal tip 38 can be appropriately restrained. The longitudinal axis CLa of the body 33 is the center axis of the body 33 and extends in the longitudinal direction of the body 33. In a view from a direction parallel to the center axis of the noble metal tip 38, the ground electrode 30 is axisymmetric with respect to the axis CLa.

A-3. First Evaluation Test

An evaluation test on samples of the spark plug 100 will be described. This evaluation test evaluated strength of fixation of the noble metal tip 38. Table 1 below shows parameters of the samples and the results of evaluation.

TABLE 1

| | Angular difference dAg (degrees) | | | | | | |
|---|---|---|---|---|---|---|---|
| | −11 | −10 | −5 | 0 | +5 | +10 | +11 |
| Evaluation | C | B | A | A | A | B | C |

The angular difference dAg is a difference obtained by subtracting the first angle Ag1 from the second angle Ag2 (FIG. 5). The evaluation test evaluated seven samples having an angular difference dAg of −11 degrees, −10 degrees, −5 degrees, 0 degree, +5 degrees, +10 degrees, and +11 degrees, respectively.

Figure 10:
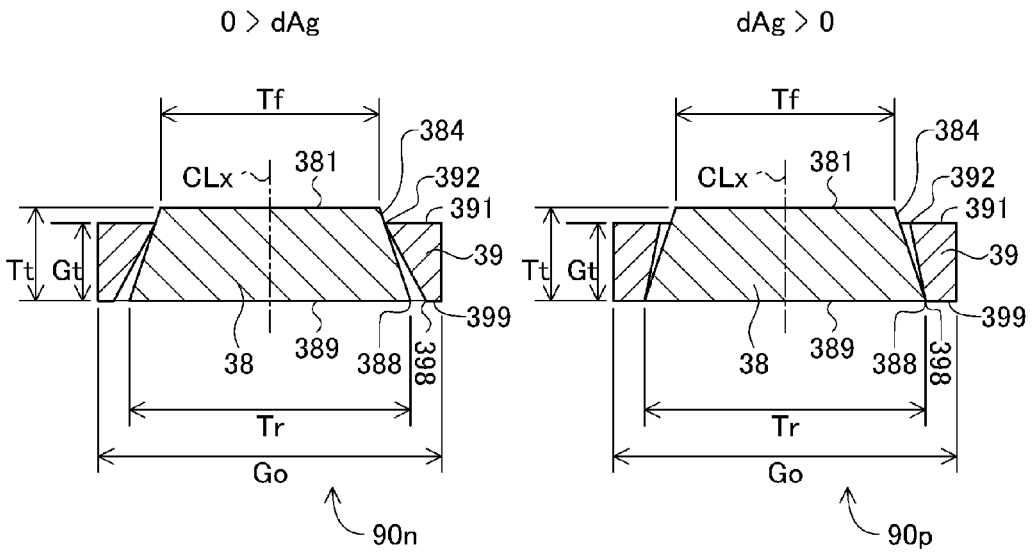
FIG. 10 is a set of sectional views showing the configurations of electrode tips 90*n* and 90*p*.

FIG. 10 is a set of sectional views showing the configuration of a noble metal tip 90*n* having a negative angular difference dAg, and the configuration of a noble metal tip 90*p* having a positive angular difference dAg. The sections are those of the noble metal tip 38 which contain the center axis CLx. In the electrode tips 90*n* and 90*p*, the rearward end surface 389 of the noble metal tip 38 is substantially flush with the rearward end surface 399 of the holder 39.

In the electrode tip 90*n* having a negative angular difference dAg, an inner circumferential edge 392 of the forward end surface 391 of the holder 39 is in contact with the outer circumferential surface 384 of the noble metal tip 38. By contrast, an inner circumferential edge 398 of the rearward end surface 399 of the holder 39 is away, in a radially outward direction, from an outer circumferential edge 388 of the rearward end surface 389 of the noble metal tip 38.

In the electrode tip 90*p* having a positive angular difference dAg, the inner circumferential edge 398 of the rearward end surface 399 of the holder 39 is in contact with the outer circumferential edge 388 of the rearward end surface 389 of the noble metal tip 38. By contrast, the inner circumferential edge 392 of the forward end surface 391 of the holder 39 is away, in a radially outward direction, from the outer circumferential surface 384 of the noble metal tip 38.

The configuration of the noble metal tip 38 was common among the seven samples subjected to the evaluation test. The seven samples differed in parameter (e.g., the first angle Ag1 (FIG. 5)) of the inner circumferential surface 394 of the holder 39 so as to differ in the angular difference dAg. The following dimensions are common among the seven samples:

First outside diameter Tf of noble metal tip 38: 2.5 mm

Second outside diameter Tr of noble metal tip 38: 2.8 mm

Height Tt of noble metal tip 38 parallel to center axis CLx: 1.0 mm

Outside diameter Go of holder 39: 3.5 mm

Height Gt of holder 39 parallel to center axis CLx: 0.9 mm

The noble metal tip 38 is formed of an alloy which contains iridium as a main component. The holder 39 and the base metal 35 of the body 33 are of the same material (herein, an alloy which contains nickel as a main component). Other configurational features of the spark plug are common among the seven samples.

Next, the evaluation test will be described. In the evaluation test, the spark plug samples were subjected to a vibration test to evaluate strength of fixation of the noble metal tip 38. Specifically, the spark plug samples were attached, with a tightening torque of 20 N·m, to an aluminum bush which was manufactured by use of an aluminum material similar to that used to manufacture an engine head; then, the vibration test specified in 3.4.4 of ISO11565 was conducted. Specifically, vibration was applied along the axial line CL to the spark plug samples at an acceleration of 30 G±2 G, a frequency of 50 Hz to 500 Hz, and a sweep rate of 1 octave/min During the application of vibration, the spark plug samples were subjected to heat cycles, each consisting of heating by use of a burner and cooling with the burner turned off.

More specifically, one cycle consisted of heating at 800° C. for two minutes and cooling for one minute. The number of cycles until the noble metal tip 38 was detached was measured. Criteria for evaluation in Table 1 are as follows: less than 500 cycles until detachment of the noble metal tip 38: "C;" 500 cycles to less than 1,000 cycles until detachment: "B;" and 1,000 cycles or more until detachment: "A."

As shown in Table 1, the closer to zero the angular difference dAg, the higher the evaluation. Presumably, this is for the following reason: the closer to zero the angular difference dAg, the smaller the gap between the outer circumferential surface 384 of the noble metal tip 38 and the inner circumferential surface 394 of the holder 39; thus, the closer to zero the angular difference dAg, the higher the welding strength between the noble metal tip 38 and the holder 39.

Also, as shown in Table 1, the samples having an angular difference dAg of −5 degrees to +5 degrees were evaluated as A. The samples having an angular difference dAg of −10 degrees or +10 degrees were evaluated as B. The samples having an angular difference dAg of −11 degrees or +11 degrees were evaluated as C. In this manner, the samples having an angular difference dAg of −10 degrees to +10 degrees received a high evaluation of B or A. The angular differences dAg which yielded a high evaluation of B or A were −10 degrees, −5 degrees, 0 degree, +5 degrees, and +10 degrees. Any one of these values can be employed as the lower limit of a preferred range (a range between the lower limit and the upper limit) of the angular difference dAg. Also, any one of these values larger than the selected lower limit can be employed as the upper limit of the preferred range. However, the absolute value of the angular difference dAg may be 11 degrees or more.

Presumably, joining strength between the noble metal tip 38 and the holder 39 varies mainly with the size of a gap between the outer circumferential surface 384 of the noble metal tip 38 and the inner circumferential surface 394 of the holder 39 (FIG. 10); i.e., with the angular difference dAg. Therefore, presumably, the preferred range of the angular difference dAg is applicable irrespective of dimensional parameters except for the angular difference dAg. For example, presumably, the above-mentioned preferred range of the angular difference dAg is applicable to a configuration which differs in at least one of the height Tt and the outside diameters Tr and Tf of the noble metal tip 38 and the height Gt and the outside diameter Go of the holder 39. Also, presumably, the above-mentioned preferred range of the angular difference dAg is applicable to other embodiments to be described below. In any case, through employment of the above-mentioned preferred range of the angular difference dAg, a positional shift of the noble metal tip 38 in relation to the holder 39 can be restrained.

B. Second Embodiment

Figure 11:
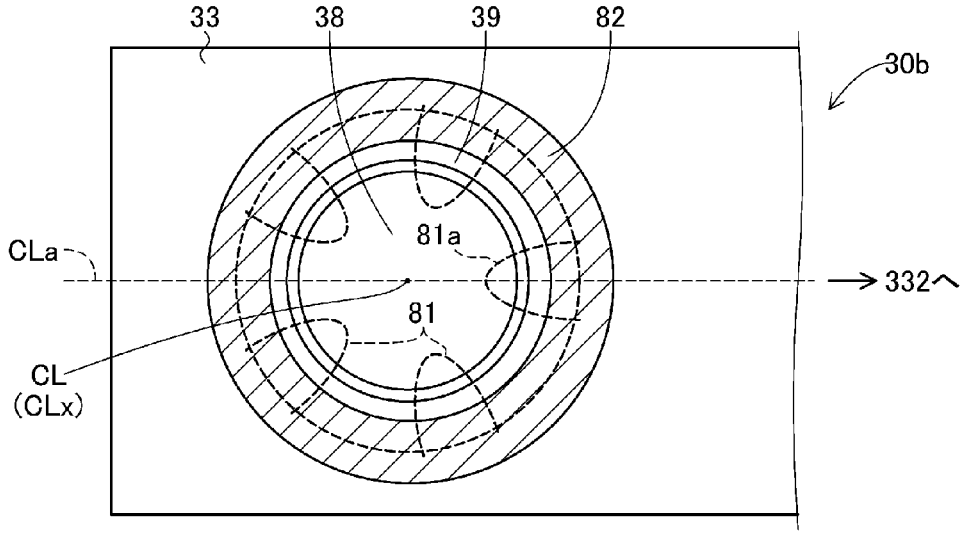
FIG. 11 is a schematic view showing another embodiment of the ground electrode.

FIG. 11 is a schematic view showing another embodiment of the ground electrode. FIG. 11 schematically shows the noble metal tip 38 of a ground electrode 30*b* and its vicinity as viewed in the first direction D1 from the side toward the second direction D2 as in the case of FIG. 3. The ground electrode 30*b* of the second embodiment differs from the ground electrode 30 of the first embodiment shown in FIG. 3 in that a plurality of the first fusion zones 81 are disposed at such positions as not to be directly opposite one another with respect to the center axis CLx of the noble metal tip 38. By virtue of such arrangement, in the case where the noble metal tip 38 and the holder 39 differ in thermal expansion coefficient, thermal stress generated as a result of the difference in thermal expansion coefficient can be mitigated through deformation of those portions of the noble metal tip 38 which are located directly opposite the respective first fusion zones 81 with respect to the center axis CLx. Also, the thermal stress can be mitigated through deformation of those portions of the holder 39 which are located directly opposite the respective first fusion zones 81 with respect to the center axis CLx. As a result, there can be reduced the possibility of breakage of the noble metal tip 38 or the holder 39 caused by the thermal stress.

Suppose that a plurality of the first fusion zones 81 are disposed at such positions as to be directly opposite one another with respect to the center axis of the noble metal tip 38. In this case, those portions of the noble metal tip 38 which are located directly opposite one another with respect to the center axis of the noble metal tip 38 are fixed to the holder 39 through the respective first fusion zones 81. Suppose that the noble metal tip 38 shrinks as a result of temperature change. In this case, since the diametrical opposite portions of the noble metal tip 38 are fixed through the first fusion zones 81, the noble metal tip 38 fails to appropriately shrink, resulting in occurrence of cracking in the noble metal tip 38. In the embodiment of FIG. 11, those portions of the noble metal tip 38 which are located directly opposite the respective first fusion zones 81 with respect to the center axis are deformed in such a manner as to move away from the holder 39, whereby occurrence of cracking can be restrained.

Other configurational features of the ground electrode 30*b* of the second embodiment are similar to those of the ground electrode 30 of the first embodiment. In FIG. 11, elements of the ground electrode 30*b* of the second embodiment similar to those of the ground electrode 30 of the first embodiment are denoted by like reference numerals, and repeated description thereof is omitted. The ground electrode 30*b* of the second embodiment can replace the ground electrode 30 of the first embodiment in application to the spark plug 100. Also, the manufacturing method which has been described with reference to FIG. 4 can be applied to manufacture of the ground electrode 30*b*.

C. Third Embodiment

Figure 12:
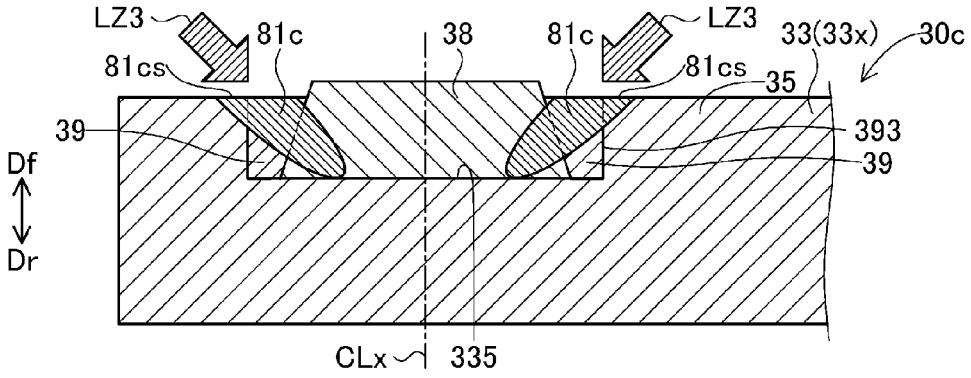
FIG. 12 is a schematic view showing a further embodiment of the ground electrode.

FIG. 12 is a schematic view showing a further embodiment of the ground electrode. FIG. 12 shows a fragmentary section of the noble metal tip 38 of a ground electrode 30*c* and its vicinity. This section is a section which contains the center axis CLx of the noble metal tip 38. The ground electrode 30*c* of the third embodiment differs from the ground electrode 30 of the first embodiment shown in FIGS. 2 and 8 in that the second fusion zone 82 is eliminated and that first fusion zones 81*c* extend from exposed surfaces 81*cs* exposed at the surface of the body 33 oriented in the forward direction Df into the noble metal tip 38 through the holder 39. Similar to the first embodiment of FIG. 3 or the second embodiment of FIG. 11, the ground electrode 30*c* has a plurality of the first fusion zones 81*c* disposed at substantially equal intervals along the circumferential direction.

Other configurational features of the ground electrode 30*c* of the third embodiment are similar to those of the ground electrode 30 of the first embodiment. In FIG. 12, elements of the ground electrode 30*c* of the third embodiment similar to those of the ground electrode 30 of the first embodiment are denoted by like reference numerals, and repeated description thereof is omitted. The ground electrode 30*c* of the third embodiment can replace the ground electrode 30 of the first embodiment in application to the spark plug 100.

In the case of application of the ground electrode 30*c* of the third embodiment, the manufacturing method of FIG. 4 is modified as follows. In step S110, the noble metal tip 38 and the holder 39 are disposed in the recess 335 formed in the body 33, in such a condition that the noble metal tip 38 is fitted into the through hole 395 of the holder 39. Step S115 is eliminated. In step S130, the body 33, the holder 39, and the noble metal tip 38 are welded through laser welding. Arrows LZ3 of FIG. 12 schematically indicate laser beams used for welding in step S130. The laser beam LZ3 is radiated onto the boundary between the inner circumferential surface of the recess 335 and the outer circumferential surface 393 of the holder 39 from the side toward the forward direction Df. The laser beam LZ3 is radiated from outside toward the center axis CLx in a direction oblique to the center axis CLx. By use of such laser beam LZ3, there are formed the first fusion zones 81*c* which extend from the surfaces (including the exposed surfaces 81*cs*), oriented in the forward direction Df, of the body 33 and the holder 39 into the noble metal tip 38 through the holder 39. Other steps of FIG. 4 are similar to those described in the section of the first embodiment.

As mentioned above, in the ground electrode 30*c* of the third embodiment, the first fusion zones 81*c* which join the noble metal tip 38 and the holder 39 have the respective exposed surfaces 81*cs* which are exposed at the surface of the body 33. That is, the first fusion zones 81*c* extend from the surface of the body 33 into the noble metal tip 38 through the holder 39. Such first fusion zone 81*c* can be easily formed through a single time of welding. Accordingly, a process of manufacturing the spark plug can be simplified. Also, since the first fusion zones 81*c* directly join the noble metal tip 38 and the body 33, the first fusion zones 81*c* can easily release heat from the noble metal tip 38 to the body 33. As a result, erosion of the noble metal tip 38 can be restrained.

In the third embodiment also, preferably, at least one first fusion zone 81*c* is located toward the proximal end 332 with respect to the center axis of the noble metal tip 38 similar to the case of the first fusion zones 81*a* of FIGS. 3 and 11. Also, preferably, in a view from a direction parallel to the center axis of the noble metal tip 38, at least one first fusion zone 81*c* is superposed on the longitudinal axis CLa of the body 33 while being located toward the proximal end 332 with respect to the center axis of the noble metal tip 38 as in the case of the first fusion zones 81*a* of FIGS. 3 and 11. According to this configuration, the first fusion zones 81*c* can appropriately cool the noble metal tip 38.

D. Fourth Embodiment

Figure 13:
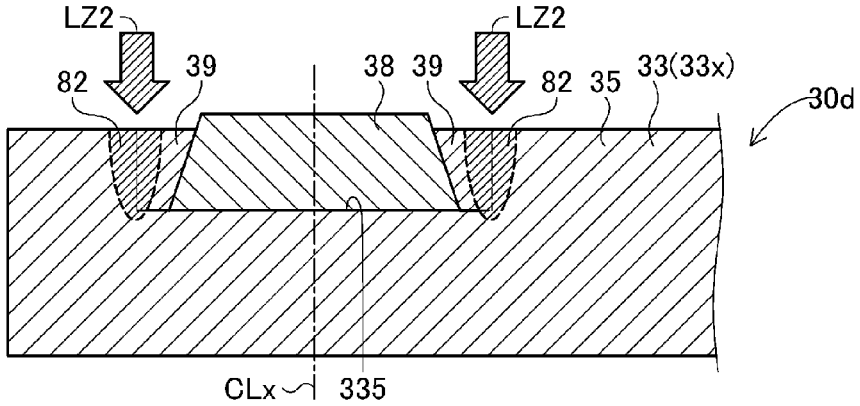
FIG. 13 is a schematic view showing a still further embodiment of the ground electrode.

FIG. 13 is a schematic view showing a still further embodiment of the ground electrode. FIG. 13 shows a fragmentary section of the noble metal tip 38 of a ground electrode 30*d* and its vicinity. This section is a section which contains the center axis CLx of the noble metal tip 38. The ground electrode 30*d* of the fourth embodiment differs from the ground electrode 30 of the first embodiment shown in FIGS. 2 and 8 only in that the first fusion zones 81 are eliminated. Other configurational features of the ground electrode 30*d* are similar to those of the ground electrode 30 of the first embodiment. In FIG. 13, elements of the ground electrode 30*d* of the fourth embodiment similar to those of the ground electrode 30 of the first embodiment are denoted by like reference numerals, and repeated description thereof is omitted. The ground electrode 30*d* of the fourth embodiment can replace the ground electrode 30 of the first embodiment in application to the spark plug 100.

In the ground electrode 30*d* of the fourth embodiment, similar to the ground electrode 30 of the first embodiment shown in FIGS. 2 and 3, the second fusion zone 82 which joins the holder 39 and the body 33 is away from the noble metal tip 38. Thus, a noble metal component of the noble metal tip 38 is restrained from being mixed into the second fusion zone 82. As a result, oxidation of the second fusion zone 82 can be restrained.

In the case of application of the ground electrode 30*d* of the fourth embodiment, step S115 is eliminated from the manufacturing method of FIG. 4. Other steps are similar to those described in the section of the first embodiment. Accordingly, the number of times of welding can be reduced; therefore, a process of manufacturing the spark plug can be simplified. Although welding of the noble metal tip 38 and the body 33 is eliminated, as described above with reference to FIG. 5, since the first inside diameter Gf of the holder 39 is less than the second outside diameter Tr of the noble metal tip 38, there can be restrained detachment of the noble metal tip 38 from the through hole 395 of the holder 39 in the forward direction Df.

Presumably, the preferred range of the angular difference dAg specified from Table 1 mentioned above can also be applied to the present embodiment. Through employment of the preferred range of the angular difference dAg, a positional shift of the noble metal tip 38 in relation to the holder 39 can be restrained.

E. Fifth Embodiment

Figure 14:
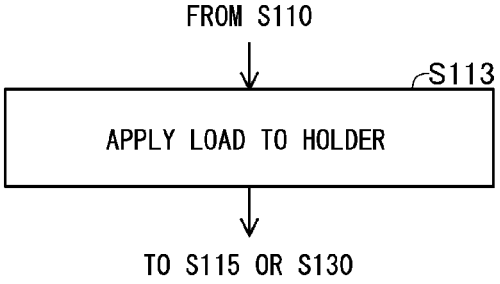
FIG. 14 is an explanatory view for explaining another embodiment of a method of manufacturing a spark plug 100.

FIG. 14 is an explanatory view for explaining another embodiment of a method of manufacturing the spark plug 100. FIG. 14 shows step S113. Step S113 is added between step S110 and step S115 in FIG. 14.

Figure 15:
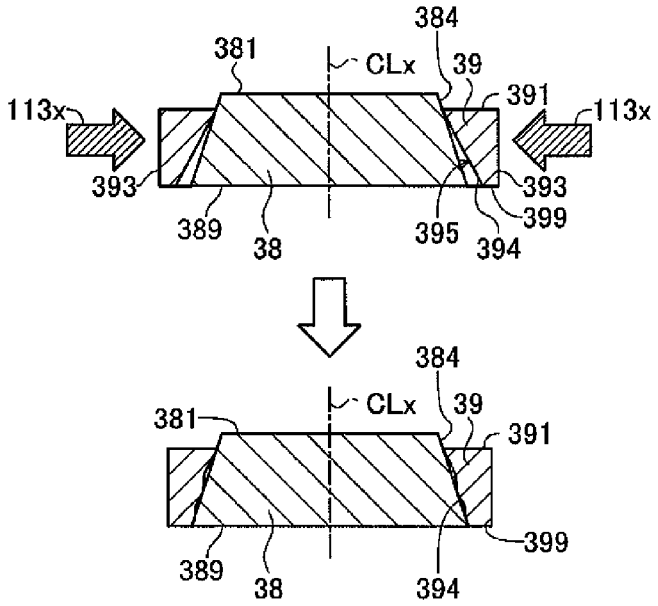
FIG. 15 is a schematic view showing a process in step S113.

FIG. 15 is a schematic view showing a process in step S113. In step S113, in order to reduce a gap formed between the outer circumferential surface 384 of the noble metal tip 38 and the inner circumferential surface 394 of the holder 39, in a condition in which the noble metal tip 38 is disposed in the through hole 395 of the holder 39, a radial load 113*x* directed toward the center axis CLx is applied to the holder 39. The load 113*x* plastically deforms the holder 39, thereby increasing a contact area between the inner circumferential surface 394 of the holder 39 and the outer circumferential surface 384 of the noble metal tip 38. As a result, a positional shift of the noble metal tip 38 in relation to the holder 39 can be restrained. Also, heat of the noble metal tip 38 can be appropriately released to the body 33 through the holder 39.

Preferably, the load 113*x* is applied toward the center axis CLx from a plurality of directions. That is, preferably, the load 113*x* is applied toward the center axis CLx at a plurality of positions on the outer circumferential surface 393 of the holder 39. Such application of the load 113*x* increases a contact area between the inner circumferential surface 394 of the holder 39 and the outer circumferential surface 384 of the noble metal tip 38.

In the case of elimination of step S115 of FIG. 4, step S113 is performed between step S110 and step S130. For example, in the case of application of the ground electrodes 30*c* and 30*d* of the embodiments of FIGS. 12 and 13, respectively, in step S110, the noble metal tip 38 is disposed in the through hole 395 of the holder 39 at a position located externally of the recess 335 of the body 33. Then, in step S113, the load 113*x* is applied to the holder 39. In step S130 after step S113, the assembly of the noble metal tip 38 and the holder 39 is disposed in the recess 335 of the body 33.

F. Sixth Embodiment

F-1. Configuration of Ground Electrode 30*z*

Figure 16:
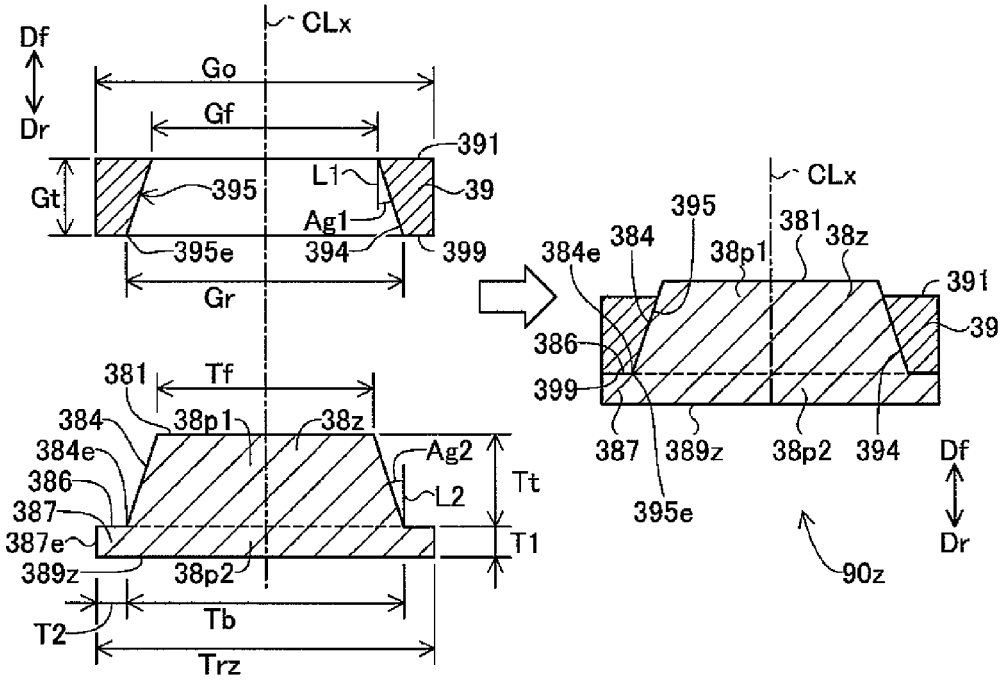
FIG. 16 is a schematic view showing another embodiment of the electrode tip.
Figure 17:
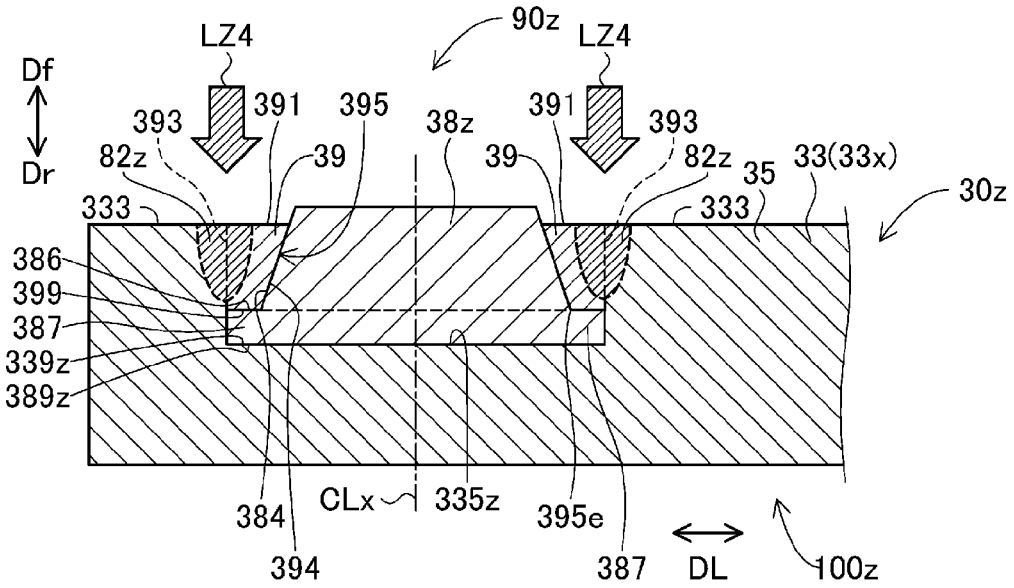
FIG. 17 is a schematic view showing a ground electrode 30*z*.

FIG. 16 is a schematic view showing another embodiment of the electrode tip. FIG. 17 is a schematic view of a ground electrode 30*z* having an electrode tip 90*z* of FIG. 16. The ground electrode 30*z* of the sixth embodiment can replace the ground electrode 30 of the first embodiment in application to the spark plug 100. A spark plug 100*z* having the ground electrode 30*z* can be manufactured according to the procedure similar to that of FIG. 4.

Similar to FIG. 5, FIG. 16 shows sections which contain the center axis CLx of the noble metal tip 38*z*. FIG. 16 shows, at the left, the noble metal tip 38*z* and the holder 39 which are arranged coaxially. FIG. 16 shows, at the right, a condition in which a portion of the noble metal tip 38*z* is disposed within the through hole 395 of the holder 39. A member 90*z* composed of the noble metal tip 38*z* and the holder 39 is called the "electrode tip 90*z*." The directions Df and Dr are similar to those of FIG. 5.

The noble metal tip 38*z* differs from the noble metal tip 38 of FIG. 5 only in that the noble metal tip 38*z* is composed of a first portion 38*p*1 similar in shape to the noble metal tip 38 of FIG. 5 and a second portion 38*p*2 connected to the first portion 38*p*1 on the side toward the rearward direction Dr. In the following description, elements of the noble metal tip 38*z* similar to those of the noble metal tip 38 of FIG. 5 are denoted by like reference numerals, and repeated description thereof is omitted. The holder 39 of the present embodiment is the same as that of FIG. 5.

In the present embodiment, the noble metal tip 38*z* having the first portion 38*p*1 and the second portion 38*p*2 is formed integrally. The second portion 38*p*2 has the shape of a disk centered on the center axis CLx. In FIG. 16, a second outside diameter Trz is the outside diameter of a rearward end surface 389*z*; i.e., the outside diameter of the second portion 38*p*2, of the noble metal tip 38*z*. In FIG. 16, a third outside diameter Tb is the outside diameter of an end of the first portion 38*p*1 oriented in the rearward direction Dr and is equal to the second outside diameter Tr of FIG. 5. In the present embodiment, the second outside diameter Trz is larger than the third outside diameter Tb. An outer circumferential portion 387 (called the protrusion 387) of the second portion 38*p*2 which encompasses an outer circumferential end 387*e* protrudes radially outward of that end 384*e* of the outer circumferential surface 384 of the first portion 38*p*1 which is oriented in the rearward direction Dr.

As shown at the right of FIG. 16, the first portion 38*p*1 of the noble metal tip 38*z* is disposed in the through hole 395 of the holder 39. The disposition of the first portion 38*p*1 in relation to the holder 39 is similar to that of the noble metal tip 38 in relation to the holder 39 of FIG. 5. The third outside diameter Tb of the first portion 38*p*1 of the noble metal tip 38*z* is substantially equal to the second inside diameter Gr of the holder 39. The protrusion 387 of the noble metal tip 38*z* protrudes radially outward of an edge 395*e* of the through hole 395 at the rearward end surface 399 of the holder 39. That surface 386 of the protrusion 387 which is oriented in the forward direction Df is in contact with the rearward end surface 399 of the holder 39. In the example of FIG. 16, the outside diameter Go of the holder 39 is substantially equal to the second outside diameter Trz of the noble metal tip 38*z*.

However, the outside diameter Go of the holder 39 may be larger than the second outside diameter Trz of the noble metal tip 38*z*.

The electrode tip 90*z* shown at the right of FIG. 16 is formed in step S110 of FIG. 4. In the present embodiment, step S115 of FIG. 4 is eliminated.

FIG. 17 is a schematic view showing the ground electrode 30*z* of the present embodiment. Similar to FIG. 13, FIG. 17 shows a fragmentary section which contains the center axis CLx of the noble metal tip 38*z*. The ground electrode 30*z* is formed through steps S120, S125, and S130 of FIG. 4. In step S120 of FIG. 4, similar to the case of the first embodiment described above, the assembly 100*x* is formed. Then, in step S125, a recess 335*z* (FIG. 17) is formed in the body 33*x*. The recess 335*z* has a substantially circular columnar shape which accommodates therein the holder 39 (FIG. 16) and the second portion 38*p*2 of the noble metal tip 38*z*. In step S130, the electrode tip 90*z* is fitted into the recess 335*z*, and the holder 39 is welded to the body 33*x*. As shown in FIG. 17, the forward end surface 391 of the holder 39 is substantially flush with that surface 333 of the body 33*x* which is oriented in the forward direction Df.

FIG. 17 schematically shows welding in step S130. The electrode tip 90*z* is disposed in the recess 335*z*. Then, a laser beam LZ4 is radiated onto the boundary between the inner circumferential surface of the recess 335*z* and the outer circumferential surface 393 of the holder 39 in the rearward direction Dr from the side toward the forward direction Df. Such radiation of the laser beam LZ4 joins the inner circumferential surface of the recess 335*z* and the outer circumferential surface 393 of the holder 39; i.e., forms a fusion zone 82*z* which joins the body 33*x* (herein, the base metal 35) and the holder 39. The fusion zone 82*z* extends in the rearward direction Dr from the forward end surface 391 of the holder 39 to a position located on the side toward the forward direction Df with respect to the protrusion 387 of the noble metal tip 38*z*. That is, the fusion zone 82*z* joins only the body 33*x* and the holder 39 and is away from the noble metal tip 38*z*. Thus, components of the noble metal tip 38*z* are restrained from being mixed into the fusion zone 82*z*, whereby oxidation of the fusion zone 82*z* can be restrained. The laser beam LZ4 is radiated along the entire circumference of the boundary between the inner circumferential surface of the recess 335*z* and the outer circumferential surface 393 of the holder 39.

As shown in FIG. 17, the protrusion 387 of the noble metal tip 38*z* is held between the rearward end surface 399 of the holder 39 and a bottom surface 339*z* of the recess 335*z*. The surface 386 of the protrusion 387 which is oriented in the forward direction Df is in contact with the surface 399 of the holder 39 which is oriented in the rearward direction Dr. Thus, there is restrained a positional shift of the noble metal tip 38*z* in the forward direction Df. As a result, the gap g between the noble metal tip 38*z* and the center electrode 20 (FIG. 1) can be maintained intact. Also, that surface 389*z* of the protrusion 387 which is oriented in the rearward direction Dr is in contact with the bottom surface 339*z* of the recess 335*z*. Thus, there is restrained a positional shift of the noble metal tip 38*z* in the rearward direction Dr. Therefore, appropriate attachment of the noble metal tip 38*z* can be easily implemented.

FIG. 16 shows, at the left, the parameters Gf, Gr, Tf, and Trz of the noble metal tip 38*z* and the holder 39. In the present embodiment, the following three relations hold.

1) first inside diameter Gf<second outside diameter Trz;

2) first inside diameter Gf<second inside diameter Gr; and 3) first outside diameter Tf<second outside diameter Trz.

By virtue of the above relations, there can be restrained detachment of the noble metal tip 38*z* from the ground electrode 30*z*.

In step S140 of FIG. 4, similar to the case of the embodiment described with reference to FIG. 9, the body 33*x* is bent, thereby forming the gap g. Thus, the spark plug having the ground electrode 30*z* is completed.

Figure 18:
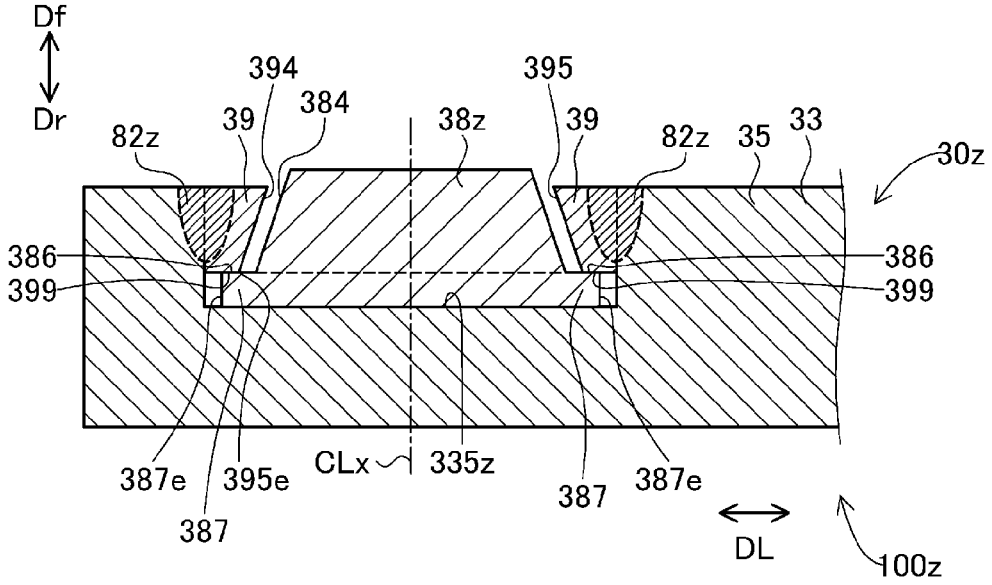
FIG. 18 is a fragmentary sectional view showing an example condition in which the temperature of the ground electrode 30*z* has increased.

FIG. 18 is a fragmentary sectional view showing an example condition in which the temperature of the ground electrode 30*z* has increased. FIG. 18 shows a fragmentary section similar to that of FIG. 17. Combustion gas generated within a combustion chamber causes an increase in temperature of the ground electrode 30*z* (FIG. 17 shows a condition at the room temperature (herein, 20° C.)). As the temperature of the ground electrode 30*z* increases, the members of the ground electrode 30*z* thermally expand. In the example of FIG. 18, the body 33 thermally expands in the longitudinal direction DL. The fragmentary section of FIG. 18 is a section which contains the center axis CLx and is taken in parallel with the longitudinal direction DL.

As a result of expansion of the body 33 in the longitudinal direction DL, the recess 335*z* expands in the longitudinal direction DL. The same also applies to the recess 335 of the ground electrode 30 of FIG. 2. As in the case of the ground electrode 30 of FIG. 2, in the case where the noble metal tip 38 and the holder 39 are fixed together through the first fusion zones 81, and the holder 39 and the body 33 are fixed together through the second fusion zone 82, the holder 39 and, in turn, the through hole 395 are pulled by the expanding body 33 and thus expands in the longitudinal direction DL. In this connection, in the case where the noble metal tip 38 is lower in thermal expansion coefficient than the body 33, the noble metal tip 38 may possibly break as a result of the noble metal tip 38 being pulled by the body 33 or the holder 39. Meanwhile, in the present embodiment, as shown in FIGS. 17 and 18, the holder 39 is welded to the body 33, but the noble metal tip 38*z* is not welded to either of the holder 39 and the body 33. Thus, the noble metal tip 38*z* resides in the recess 335*z* while being not pulled by either of the body 33 and the holder 39. As a result, even in the case where the noble metal tip 38*z* is lower in thermal expansion coefficient than the body 33, there can be restrained breakage of the noble metal tip 38*z* which could otherwise result from the noble metal tip 38*z* being pulled by the body 33 or the holder 39. For example, in the example of FIG. 18, the gap between the outer circumferential surface 384 of the noble metal tip 38*z* and the inner circumferential surface 394 of the holder 39 is greater than that at the room temperature (FIG. 17).

Figure 19:
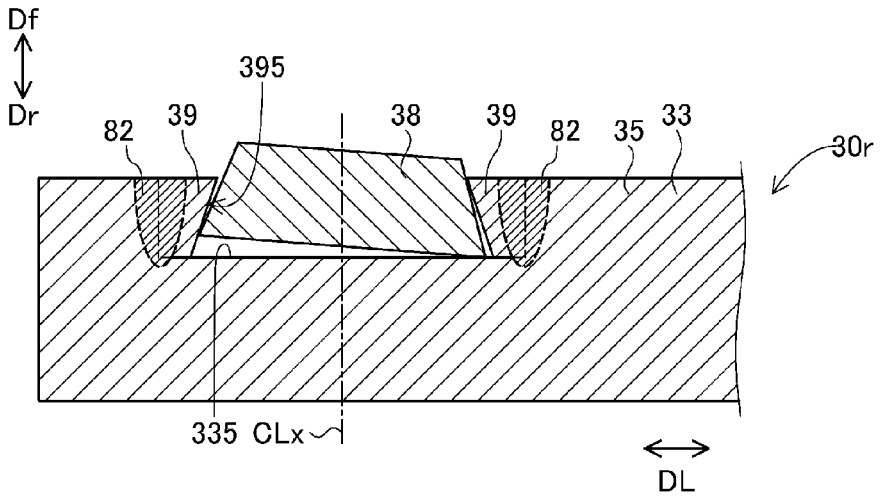
FIG. 19 is a fragmentary sectional view showing a condition in which the temperature of a reference example of the ground electrode has increased.

FIG. 19 is a fragmentary sectional view showing a condition in which the temperature of a reference example of a ground electrode 30*r* has increased. The ground electrode 30*r* of the reference example is similar in configuration to the ground electrode 30*d* of FIG. 13. FIG. 19 shows a fragmentary section similar to that of FIG. 13. In the following description, elements of the ground electrode 30*r* similar to those of the ground electrode 30*d* are denoted by like reference numerals, and repeated description thereof is omitted. The noble metal tip 38 (FIG. 19) does not have the protrusion 387 (FIG. 17) and is not welded (i.e., fixed) to either of the holder 39 and the body 33. Combustion gas generated within a combustion chamber causes an increase in the temperature of the ground electrode 30*r*. The body 33 thermally expands in the longitudinal direction DL. As a result, the recess 335 expands in the longitudinal direction DL. In the reference example, the holder 39 is welded to the body 33. Accordingly, the holder 39 and, in turn, the through hole 395 are pulled by the expanding body 33 and thus expands in the longitudinal direction DL. However, the noble metal tip 38 is not welded to either of the holder 39 and the body 33. Accordingly, the noble metal tip 38 resides in the expanded recess 335 while being not pulled by either of the body 33 and the holder 39. As a result, the noble metal tip 38 may possibly shift in position in the forward direction Df.

By contrast, in the present embodiment, as described with reference to FIG. 17, the noble metal tip 38*z* has the protrusion 387 which protrudes radially outward of the edge 395*e* of the through hole 395 at the rearward end surface 399 of the holder 39. Thus, even in the case where, as shown in FIG. 18, the holder 39 (in turn, the through hole 395) expands in the longitudinal direction DL, the outer circumferential end 387*e* of the protrusion 387 is located radially outward of the edge 395*e* of the through hole 395 at the rearward end surface 399 of the expanded holder 39. In this manner, that surface 386 of the protrusion 387 which is oriented in the forward direction Df is in contact with that rearward end surface 399 of the expanded holder 39 which is oriented in the rearward direction Dr, thereby restraining the positional shift of the noble metal tip 38*z* in the forward direction Df. As a result, even when the temperature of the ground electrode 30*z* increases, the gap g between the noble metal tip 38*z* and the center electrode 20 can be maintained intact.

Presumably, the preferred range of the angular difference dAg specified from aforementioned Table 1 is also applicable to the present embodiment. Employment of the angular difference dAg within the preferred range restrains positional shift of the noble metal tip 38*z* in relation to the holder 39. Also, step S113 of FIG. 14 may be applied to the method of manufacturing the spark plug of the present embodiment. Such application of step S113 restrains a positional shift of the noble metal tip 38*z* in relation to the holder 39. Also, release of heat from the noble metal tip 38 to the body 33 is facilitated through the holder 39.

F-2. Second Evaluation Test

An evaluation test on samples of a spark plug having the ground electrode 30*z* (FIG. 17) will be described. A test method and criteria for test results are similar to those described above with reference to Table 1. That is, strength of attachment of the noble metal tip 38*z* was evaluated. Table 2 below shows parameters of the samples and the results of evaluation.

TABLE 2

| Thickness T1 (mm) | 0.1 | 0.2 | 0.3 | 0.4 | 0.5 |
|---|---|---|---|---|---|
| Evaluation | C | B | A | A | A |

A thickness T1 is of the protrusion 387 in a direction parallel to the center axis CLx of the noble metal tip 38*z* (FIG. 16). The evaluation test evaluated five samples having a thickness T1 of 0.1, 0.2, 0.3, 0.4, and 0.5 (mm), respectively. The depth (length in a direction parallel to the center axis CLx) of the recess 335*z* (FIG. 17) was adjusted according to the thickness T1. The size of the first portion 38*p*1 of the noble metal tip 38*z* and the size of the holder 39 were common among the five samples. The following dimensions are common among the five samples:

First outside diameter Tf of noble metal tip 38*z:* 2.5 mm

Second outside diameter Trz of noble metal tip 38*z:* 3.1 mm

Third outside diameter Tb of noble metal tip 38*z:* 2.8 mm

Height Tt of first portion 38*p*1 along center axis CLx: 1.0 mm

Second inside diameter Gr of holder 39: 2.8 mm

Outside diameter Go of holder 39: 3.5 mm

Angular difference dAg (Ag2−Ag1): 0 degree

Height Gt of holder 39 along center axis CLx: 0.9 mm

The noble metal tip 38*z* is formed of an alloy which contains iridium as a main component. The holder 39 and the base metal 35 of the body 33 are of the same material (herein, an alloy which contains nickel as a main component). Other configurational features of the spark plug are common among the five samples. The dimensions and angles of the samples are those at the room temperature (herein, 20° C.). The same also applies to the dimensions and angles of the samples used in the first evaluation test mentioned above.

As shown in Table 2, the sample having a thickness T1 of 0.1 mm was evaluated as C. The sample suffered breakage of the protrusion 387 in the evaluation test. Also, as shown in Table 2, the sample having a thickness T1 of 0.2 mm was evaluated as B, and the samples having a thickness T1 of 0.3 mm, 0.4 mm, and 0.5 mm, respectively, were evaluated as A. In this manner, a sample having a large thickness T1 was evaluated better than a sample having a small thickness T1. Conceivably, this is for the following reason: in the case of a large thickness T1, there is restrained breakage of the protrusion 387 which could otherwise result from vibration, thereby restraining detachment of the noble metal tip 38*z*.

The thicknesses T1 which yielded a high evaluation of B or A were 0.2 mm, 0.3 mm, 0.4 mm, and 0.5 mm. Any one of these values can be employed as the lower limit of a preferred range (a range between the lower limit and the upper limit) of the thickness T1. For example, a thickness of 0.2 mm or more can be employed as the thickness T1. Also, any one of these values larger than the selected lower limit can be employed as the upper limit of the preferred range. For example, a value of 0.5 mm or less may be employed as the thickness T1. The larger the thickness T1, the more the possibility of breakage of the protrusion 387 can be reduced. Therefore, a value larger than the evaluated largest thickness T1 of 0.5 mm may be employed. For example, a value of 1.0 mm or less may be employed as the thickness T1. Notably, the thickness T1 may be less than 0.2 mm Presumably, the likelihood of breakage of the protrusion 387 depends greatly on the thickness T1. Therefore, presumably, the preferred range of the thickness T1 specified from Table 2 is applicable irrespective of dimensional parameters except for the thickness T1. For example, presumably, the above-mentioned preferred range of the thickness T1 is applicable to a configuration which differs in at least one of the height Tt and the outside diameters Trz, Tf, and Tb of the noble metal tip 38*z*, the height Gt, the outside diameter Go, and the inside diameters Gf and Gr of the holder 39, and the angular difference dAg.

F-3. Third Evaluation Test

Another evaluation test on samples of a spark plug having the ground electrode 30*z* (FIG. 17) will be described. A test method and criteria for test results are similar to those described above with reference to Table 1. That is, strength of attachment of the noble metal tip 38*z* was evaluated. Table 3 below shows parameters of the samples and the results of evaluation.

TABLE 3

| | Protrusion length T2 (mm) | | | | | | |
|---|---|---|---|---|---|---|---|
| | 0.02 | 0.05 | 0.1 | 0.15 | 0.2 | 0.25 | 0.3 |
| Evaluation | C | B | A | A | A | B | C |

A protrusion length T2 is a length, along a radial direction of a circle centered on the center axis CLx, between the rearward end 384*e* of the outer circumferential surface 384 of a portion of the noble metal tip 38*z* (FIG. 16) disposed within the through hole 395 of the holder 39 and the outer circumferential end 387*e* of the protrusion 387. In the embodiment of FIG. 16, the protrusion length T2 is Trz−Tb. The evaluation test evaluated seven samples having a protrusion length T2 of 0.02, 0.05, 0.1, 0.15, 0.2, 0.25, and 0.3 (mm), respectively. The size of the first portion 38*p*1 and the thickness T1 of the second portion 38*p*2 of the noble metal tip 38*z* and the size of the holder 39 were common among the seven samples. The following dimensions are common among the seven samples:

Thickness T1 of protrusion 387: 0.2 mm

First outside diameter Tf of noble metal tip 38*z*: 2.5 mm

Third outside diameter Tb of noble metal tip 38*z*: 2.8 mm

Height Tt of first portion 38*p*1 along center axis CLx: 1.0 mm

Second inside diameter Gr of holder 39: 2.8 mm

Outside diameter Go of holder 39: 3.5 mm

Angular difference dAg (Ag2−Ag1): 0 degree

Height Gt of holder 39 along center axis CLx: 0.9 mm

The noble metal tip 38*z* is formed of an alloy which contains iridium as a main component. The holder 39 and the base metal 35 of the body 33 are of the same material (herein, an alloy which contains nickel as a main component). Other configurational features of the spark plug are common among the seven samples. The dimensions and angles of the samples are those at the room temperature (herein, 20° C.).

As shown in Table 3, the sample having a protrusion length T2 of 0.02 mm was evaluated as C. In the evaluation test, the sample was free from detachment of the holder 39 from the body 33, but suffered detachment of the noble metal tip 38*z* from the holder 39. Conceivably, this is for the following reason: in the case where the holder 39 (in turn, the through hole 395) expanded in the longitudinal direction DL as shown in FIG. 18, due to a small value of the protrusion length T2, the protrusion 387 failed to restrain detachment of the noble metal tip 38*z*.

The sample having a protrusion length T2 of 0.3 mm was evaluated as C. In the evaluation test, the sample suffered breakage of the protrusion 387. Conceivably, this is for the following reason: since the protrusion length T2 has a large value, the protrusion 387 is likely to break at the root of the protrusion 387 (in the vicinity of the rearward end 384*e* of the outer circumferential surface 384 (FIG. 16)).

The sample having a protrusion length T2 of 0.05 mm was evaluated as B; the samples having a protrusion length T2 of 0.1 mm, 0.15 mm, and 0.2 mm, respectively, were evaluated as A; and the sample having a protrusion length T2 of 0.25 mm was evaluated as B. In this manner, the protrusion lengths T2 which yielded a high evaluation of B or A were 0.05 mm, 0.1 mm, 0.15 mm, 0.2 mm, and 0.25 mm. Any one of these values can be employed as the lower limit of a preferred range (a range between the lower limit and the upper limit) of the protrusion length T2. For example, a value of 0.05 mm or more may be employed as the lower limit of the protrusion length T2. Also, any one of these values larger than the selected lower limit can be employed as the upper limit of the preferred range. For example, a value of 0.25 mm or less may be employed as the upper limit of the protrusion length T2. However, the protrusion length T2 may be less than 0.05 mm or in excess of 0.25 mm.

Presumably, the likelihood of detachment of the noble metal tip 38*z* depends greatly on the protrusion length T2. Therefore, presumably, the preferred range of the protrusion length T2 specified from Table 3 is applicable irrespective of dimensional parameters except for the protrusion length T2. For example, presumably, the above-mentioned preferred range of the protrusion length T2 is applicable to a configuration which differs in at least one of the height Tt, the outside diameters Trz, Tf, and Tb, and the thickness T1 of the noble metal tip 38*z*, the height Gt, the outside diameter Go, and the inside diameters Gf and Gr of the holder 39, and the angular difference dAg.

G. Seventh Embodiment

Figure 20:
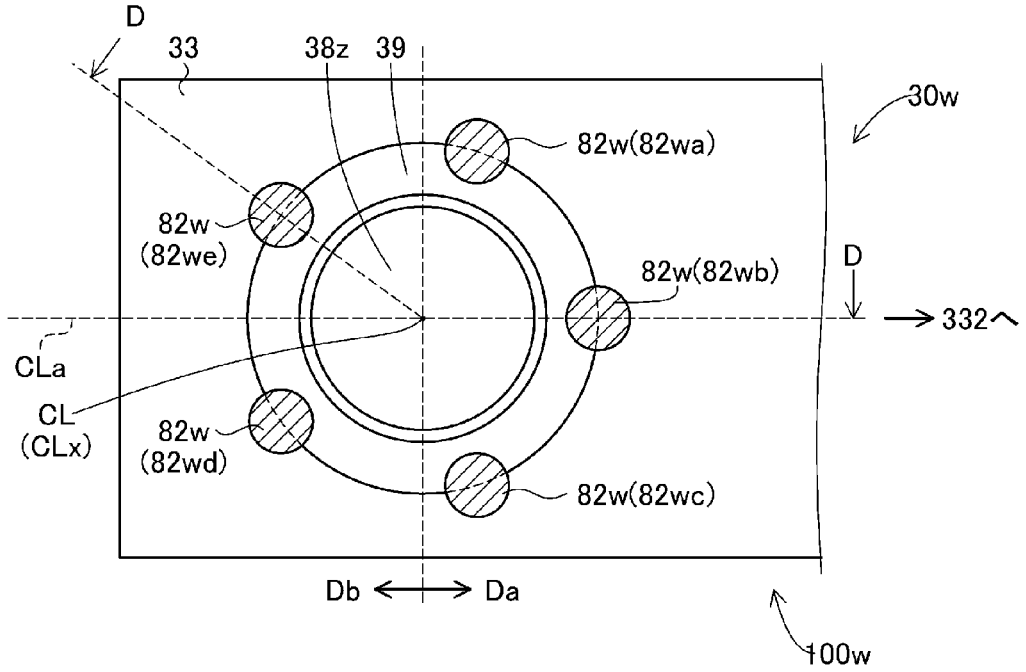
FIG. 20 is a schematic view showing a further embodiment of the ground electrode.
Figure 21:
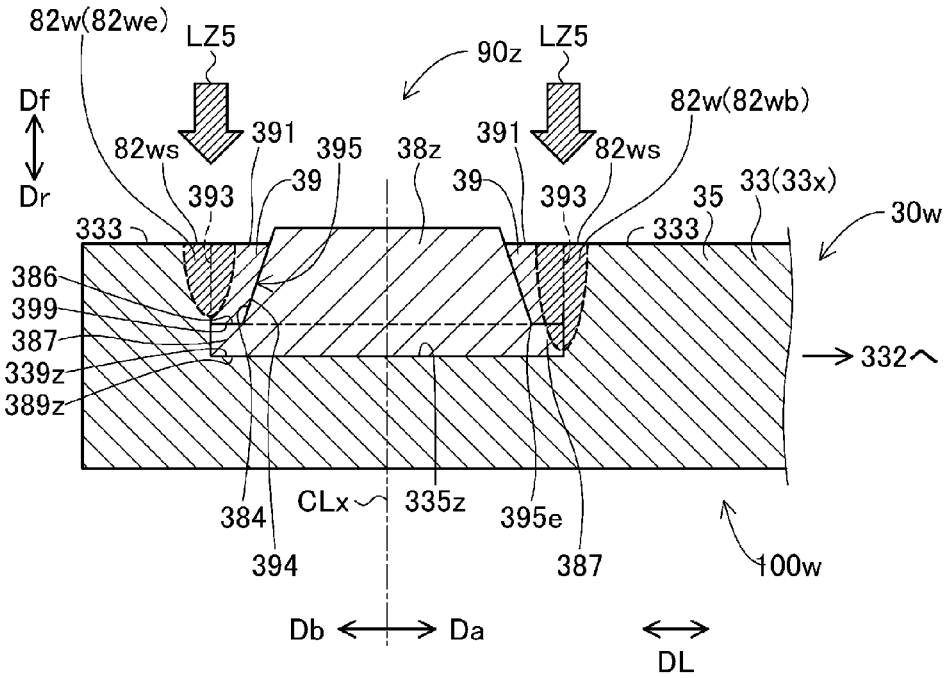
FIG. 21 is a schematic view showing the further embodiment of the ground electrode.

FIGS. 20 and 21 are schematic views showing a further embodiment of the ground electrode. A ground electrode 30*w* of the seventh embodiment can replace the ground electrode 30 of the first embodiment in application to the spark plug 100.

Similar to FIG. 11, FIG. 20 is a schematic view showing the noble metal tip 38*z* of the ground electrode 30*w* and its vicinity as viewed in the first direction D1 from the side toward the second direction D2 (in other words, as viewed in the rearward direction Dr from the side toward the forward direction Df). FIG. 21 is a sectional view taken in parallel with the center axis CLx of the noble metal tip 38*z*. The ground electrode 30*w* differs from the ground electrode 30*z* of the sixth embodiment shown in FIG. 17 in that a plurality of fusion zones 82*w* for joining the body 33 and the holder 39 are disposed away from one another along a circumferential direction of a circle centered on the center axis CLx of the noble metal tip 38*z*. Configurational features other than the fusion zones 82*w* of the ground electrode 30*w* are similar to those of the ground electrode 30*z* of FIG. 17. In the following description, elements of the ground electrode 30*w* similar to those of the ground electrode 30*z* of FIG. 17 are denoted by like reference numerals, and repeated description thereof is omitted. A spark plug 100*w* having the ground electrode 30*w* can be manufactured according to a procedure similar to that for manufacturing the spark plug 100*z* of the embodiment of FIGS. 16 and 17.

In the embodiment of FIG. 20, a plurality of (herein, five) the fusion zones 82*w* join the holder 39 and the body 33. The five fusion zones 82*w* are circumferentially disposed at substantially equal intervals.

FIG. 21 shows a D-D section of FIG. 20. The D-D section consists of a portion located on the side toward a proximal end direction Da with respect to the center axis CLx and a portion located on the side toward a distal end direction Db with respect to the center axis CLx. The proximal end direction Da is perpendicular to the center axis CLx and directed toward the proximal end 332, and the distal end direction Db is opposite the proximal end direction Da. The portion of the D-D section which is located on the side toward the proximal end direction Da with respect to the center axis CLx is a section which contains the axis CLa of the body 33 (herein, a section which passes through a fusion zone 82*wb* located closest to the proximal end 332). The portion of the D-D section which is located on the side toward the distal end direction Db with respect to the center axis CLx is a section which passes through one fusion zone 82*we*.

FIG. 21 schematically shows welding in step S130 (FIG. 4). The electrode tip 90*z* is disposed in the recess 335*z*. Then, a laser beam LZ5 is radiated on the boundary between the inner circumferential surface of the recess 335*z* and the outer circumferential surface 393 of the holder 39 in the rearward direction Dr from the side toward the forward direction Df. Such radiation of the laser beam LZ5 joins the inner circumferential surface of the recess 335*z* and the outer circumferential surface 393 of the holder 39; i.e., forms a fusion zone 82*w* which joins the body 33*x* (herein, the base metal 35) and the holder 39. The laser beam LZ5 is radiated at positions corresponding to the fusion zones 82*w*.

As shown in FIG. 21, the fusion zone 82*wb* on the side toward the proximal end direction Da extends in the rearward direction Dr from the surfaces of the body 33 and the holder 39 oriented in the forward direction Df to the protrusion 387 of the noble metal tip 38*z*. That is, the fusion zone 82*wb* joins the body 33, the holder 39, and the noble metal tip 38*z*. Although unillustrated, in the present embodiment, all of the fusion zones 82*wa*, 82*wb*, and 82*wc* (FIG. 20) which are located on the side toward the proximal end direction Da with respect to the center axis CLx join the body 33, the holder 39, and the noble metal tip 38*z*. These fusion zones 82*wa*, 82*wb*, and 82*wc* correspond to the first fusion zones which join at least the noble metal tip 38*z* and the holder 39. These fusion zones 82*wa*, 82*wb*, and 82*wc* can appropriately release heat from the noble metal tip 38*z* to the proximal end 332 through the body 33.

Meanwhile, the fusion zone 82*we* (FIG. 21) on the side toward the distal end direction Db extends in the rearward direction Dr from the surfaces of the body 33 and the holder 39 oriented in the forward direction Df to a position located on the side toward the forward direction Df with respect to the protrusion 387 of the noble metal tip 38*z*. That is, the fusion zone 82*we* joins only the body 33 and the holder 39 and is away from the noble metal tip 38*z*. Although unillustrated, in the present embodiment, all of the fusion zones 82*wd* and 82*we* (FIG. 20) which are located on the side toward the distal end direction Db with respect to the center axis CLx join only the body 33 and the holder 39. These fusion zones 82*wd* and 82*we* correspond to the second fusion zone which is away from the noble metal tip 38*z* and joins the holder 39 and the body 33.

The fusion zones 82*wd* and 82*we* on the side toward the distal end direction Db can be formed through application of the laser beam LZ5 whose intensity is weakened as compared with the case of forming the fusion zones 82*wa*, 82*wb*, and 82*wc* on the side toward the proximal end direction Da. Steps other than step S130 of FIG. 4 are similar to those of the manufacturing method of the sixth embodiment of FIG. 17.

Similar to the embodiment of FIG. 18, as the temperature of the ground electrode 30*w* increases, the recess 335*z* expands in the longitudinal direction DL of the body 33. Accordingly, the holder 39 welded to the body 33 and, in turn, the through hole 395 expand in the longitudinal direction DL. However, in the present embodiment, all of the fusion zones 82*wd* and 82*we* which are located on the side toward the distal end direction Db with respect to the center axis CLx are away from the noble metal tip 38*z*. Thus, even in the case where the noble metal tip 38*z* is lower in thermal expansion coefficient than the body 33, although the noble metal tip 38*z* is pulled in the proximal end direction Da by the fusion zones 82*wa*, 82*wb*, and 82*wc*, the noble metal tip 38*z* is not pulled in the distal end direction Db. Therefore, breakage of the noble metal tip 38*z* can be restrained.

Also, as described above with reference to FIG. 18, even in the case where the holder 39 (in turn, the through hole 395) expands in the longitudinal direction DL, through contact of the surface 386, oriented in the forward direction Df, of the protrusion 387 of the noble metal tip 38*z* with the rearward end surface 399, oriented in the rearward direction Dr, of the expanded holder 39, there can be restrained the positional shift of the noble metal tip 38*z* in the forward direction Df. As a result, even when the temperature of the ground electrode 30*w* increases, the gap g between the noble metal tip 38*z* and the center electrode 20 can be maintained intact.

A plurality of the fusion zones 82*w* are disposed at such positions as not to be located directly opposite one another with respect to the center axis CLx of the noble metal tip 38*z*. By virtue of such arrangement, in the case where the holder 39 and the body 33 differ in thermal expansion coefficient, thermal stress generated from difference in thermal expansion coefficient can be mitigated through deformation of those portions of the holder 39 which are located directly opposite the respective fusion zones 82*w* with respect to the center axis CLx. Also, such thermal stress can be mitigated through deformation of those portions of the body 33 which are located directly opposite the respective fusion zones 82*w* with respect to the center axis CLx. As a result, there can be reduced the possibility of breakage of the holder 39 or the body 33 caused by thermal stress.

Also, at least one of the fusion zones 82*w* (FIG. 20; herein, three fusion zones 82*wa*, 82*wb*, and 82*wc*) is located toward the proximal end 332 with respect to the center axis CLx of the noble metal tip 38*z*. Therefore, the ground electrode 30*w* can appropriately release heat from the holder 39 to the proximal end 332 through the body 33.

Also, as shown in FIG. 20, in a view from a direction parallel to the center axis CLx of the noble metal tip 38*z*, at least one (herein, the fusion zone 82*wb*) of the fusion zones 82*w* is superposed on the longitudinal axis CLa of the body 33 while being located toward the proximal end 332 with respect to the center axis CLx of the noble metal tip 38*z*. Therefore, the fusion zone 82*wb* can appropriately release heat from the holder 39 to the proximal end 332 through the body 33.

Also, a plurality of the fusion zones 82*w* (FIG. 21) have respective exposed surfaces 82*ws* exposed at the surface 333 of the body 33. Accordingly, the fusion zones 82*w* can be formed easily by welding (through radiation of the laser beam LZ5).

Presumably, the preferred range of the angular difference dAg specified from Table 1 mentioned above can also be applied to the present embodiment. Through employment of the preferred range of the angular difference dAg, a positional shift of the noble metal tip 38*z* in relation to the holder 39 can be restrained. Also, step S113 of FIG. 14 may be applied to the method of manufacturing the spark plug of the present embodiment. Such application of step S113 can restrain a positional shift of the noble metal tip 38*z* in relation to the holder 39. Also, there is facilitated release of heat of the noble metal tip 38*z* to the body 33 through the holder 39.

H. Eighth Embodiment

Figure 22:
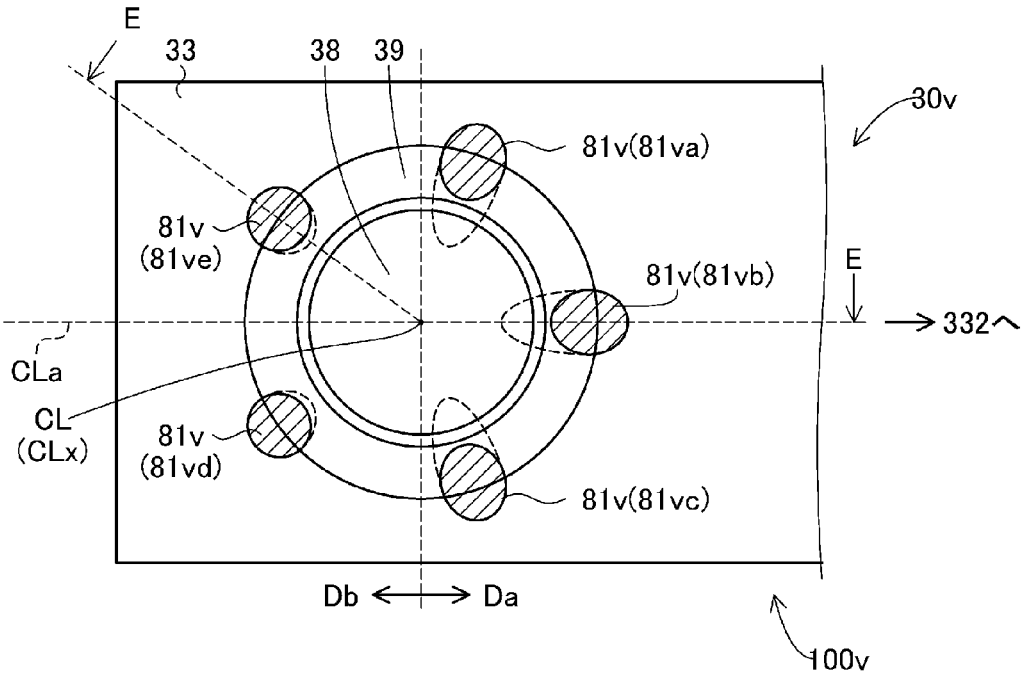
FIG. 22 is a schematic view showing a still further embodiment of the ground electrode.
Figure 23:
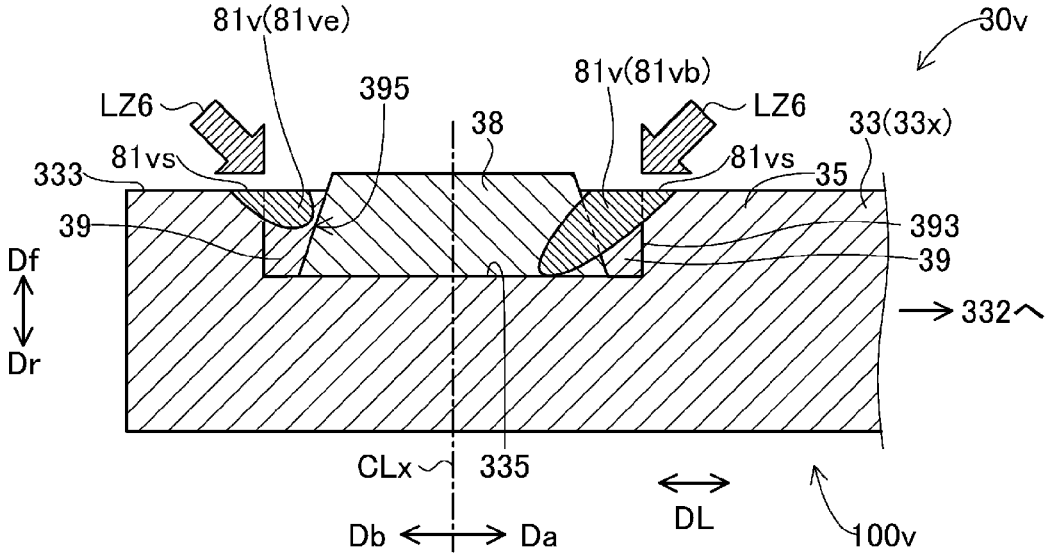
FIG. 23 is a schematic view showing the still further embodiment of the ground electrode.

FIGS. 22 and 23 are schematic views showing a still further embodiment of the ground electrode. A ground electrode 30*v* of the eighth embodiment can replace the ground electrode 30 of the first embodiment in application to the spark plug 100.

Similar to FIG. 20, FIG. 22 is a schematic view showing the noble metal tip 38 of the ground electrode 30*v* and its vicinity as viewed in the first direction D1 from the side toward the second direction D2 (in other words, as viewed in the rearward direction Dr from the side toward the forward direction Df). FIG. 23 is a sectional view taken in parallel with the center axis CLx of the noble metal tip 38. The ground electrode 30*v* differs from the ground electrode 30*c* of the third embodiment shown in FIG. 12 in that a plurality of fusion zones 81*v* for joining the body 33 and the holder 39 are disposed away from one another along a circumferential direction of a circle centered on the center axis CLx of the noble metal tip 38. Configurational features other than the fusion zones 81*v* of the ground electrode 30*v* are similar to those of the ground electrode 30*c* of FIG. 12. In the following description, elements of the ground electrode 30*v* similar to those of the ground electrode 30*c* of FIG. 12 are denoted by like reference numerals, and repeated description thereof is omitted. A spark plug 100*v* having the ground electrode 30*v* can be manufactured according to a procedure similar to that for manufacturing the spark plug having the ground electrode 30*c* of the embodiment of FIG. 12. The directions Da and Db in FIGS. 22 and 23 are similar to those described with reference to FIGS. 20 and 21.

In the embodiment of FIG. 22, a plurality of (herein, five) the fusion zones 81*v* join the holder 39 and the body 33. The five fusion zones 81*v* are disposed at substantially equal intervals along a circumferential direction.

FIG. 23 shows an E-E section of FIG. 22. Similar to the D-D section of FIG. 21, the E-E section consists of a portion located on the side toward the proximal end direction Da with respect to the center axis CLx and a portion located on the side toward the distal end direction Db with respect to the center axis CLx. The portion of the E-E section which is located on the side toward the proximal end direction Da with respect to the center axis CLx is a section which contains the axis CLa of the body 33 (herein, a section which passes through a fusion zone 81*vb* located closest to the proximal end 332). The portion of the E-E section which is located on the side toward the distal end direction Db with respect to the center axis CLx is a section which passes through one fusion zone 81*ve*.

FIG. 23 schematically shows welding in step S130 (FIG. 4). A laser beam LZ6 is radiated in the same direction as that of the laser beam LZ3 of FIG. 12. Radiation of such laser beam LZ3 forms the fusion zone 81*v* which joins the body 33 and the holder 39. The laser beam LZ6 is radiated at positions corresponding to the fusion zones 81*v*.

As shown in FIG. 23, the fusion zone 81*vb* located on the side toward the proximal end direction Da extends from the surfaces, oriented in the forward direction Df, of the body 33 and the holder 39 into the noble metal tip 38 through the holder 39. That is, the fusion zone 81*vb* joins the body 33, the holder 39, and the noble metal tip 38. Although unillustrated, in the present embodiment, all of the fusion zones 81*va*, 81*vb*, and 81*vc* (FIG. 22) which are located on the side toward the proximal end direction Da with respect to the center axis CLx join the body 33, the holder 39, and the noble metal tip 38. These fusion zones 81*va*, 81*vb*, and 81*vc* correspond to the first fusion zones which join at least the noble metal tip 38 and the holder 39. These fusion zones 81*va*, 81*vb*, and 81*vc* can appropriately release heat from the noble metal tip 38 to the proximal end 332 through the body 33.

Meanwhile, the fusion zone 81*ve* (FIG. 23) on the side toward the distal end direction Db extends from the surfaces, oriented in the forward direction Df, of the body 33 and the holder 39 to a position located within the holder 39. That is, the fusion zone 81*ve* joins only the body 33 and the holder 39 and is away from the noble metal tip 38. Although unillustrated, in the present embodiment, all of the fusion zones 81*vd* and 81*ve* (FIG. 22) which are located on the side toward the distal end direction Db with respect to the center axis CLx join only the body 33 and the holder 39. These fusion zones 81*vd* and 81*ve* correspond to the second fusion zone which is away from the noble metal tip 38 and joins the holder 39 and the body 33.

The fusion zones 81*vd* and 81*ve* on the side toward the distal end direction Db can be formed through application of the laser beam LZ6 whose intensity is weakened as compared with the case of forming the fusion zones 81*va*, 81*bv*, and 81*vc* on the side toward the proximal end direction Da. Steps other than step S130 of FIG. 4 are similar to those of the manufacturing method of the third embodiment of FIG. 12.

Similar to the embodiment of FIG. 18, as the temperature of the ground electrode 30*v* increases, the recess 335 expands in the longitudinal direction DL of the body 33. Accordingly, the holder 39 welded to the body 33 and, in turn, the through hole 395 expand in the longitudinal direction DL. However, in the present embodiment, all of the fusion zones 81*vd* and 81*ve* which are located on the side toward the distal end direction Db with respect to the center axis CLx are away from the noble metal tip 38. Thus, even in the case where the noble metal tip 38 is lower in thermal expansion coefficient than the body 33, although the noble metal tip 38 is pulled in the proximal end direction Da by the fusion zones 81*va*, 81*vb*, and 81*vc*, the noble metal tip 38 is not pulled in the distal end direction Db. Therefore, breakage of the noble metal tip 38 can be restrained.

Also, since at least one of the fusion zones 81*v* joins the body 33, the holder 39, and the noble metal tip 38, even in the case where the holder 39 (in turn, the through hole 395) expands in the longitudinal direction DL, there can be restrained the positional shift of the noble metal tip 38 in the forward direction Df. As a result, even when the temperature of the ground electrode 30*v* increases, the gap g between the noble metal tip 38 and the center electrode 20 can be maintained intact.

A plurality of the fusion zones 81*v* are disposed at such positions as not to be located directly opposite one another with respect to the center axis CLx of the noble metal tip 38. Thus, similar to the case of the embodiment of FIG. 11, there can be reduced the possibility of breakage of the noble metal tip 38 or the holder 39 caused by thermal stress. Also, similar to the case of the embodiment of FIG. 20, there can be reduced the possibility of breakage of the holder 39 or the body 33 caused by thermal stress.

Also, at least one of the fusion zones 81*v* (FIG. 22; herein, three fusion zones 81*va*, 81*vb*, and 81*vc*) is located toward the proximal end 332 with respect to the center axis CLx of the noble metal tip 38. Therefore, the ground electrode 30*v* can appropriately release heat from the holder 39 to the proximal end 332 through the body 33.

Also, as shown in FIG. 22, in a view from a direction parallel to the center axis CLx of the noble metal tip 38, at least one (herein, the fusion zone 81*vb*) of the fusion zones 81*v* is superposed on the longitudinal axis CLa of the body 33 while being located toward the proximal end 332 with respect to the center axis CLx of the noble metal tip 38. Therefore, the fusion zone 81*vb* can appropriately cool the holder 39 and, in turn, the noble metal tip 38.

Also, a plurality of the fusion zones 81*v* (FIG. 21) have respective exposed surfaces 81*vs* exposed at the surface 333 of the body 33. Accordingly, the fusion zones 81*v* can be formed easily by welding (through radiation of the laser beam LZ6).

Presumably, the preferred range of the angular difference dAg specified from aforementioned Table 1 is also applicable to the present embodiment. Employment of the angular difference dAg within the preferred range restrains a positional shift of the noble metal tip 38 in relation to the holder 39. Also, step S113 of FIG. 14 may be applied to the method of manufacturing the spark plug of the present embodiment. Such application of step S113 can restrain a positional shift of the noble metal tip 38 in relation to the holder 39. Also, there is facilitated release of heat of the noble metal tip 38 to the body 33 through the holder 39.

I. Modifications:

(1) The shape of the noble metal tips 38 and 38z and the shape of the holder 39 are not limited to those described above with reference to FIGS. 5 and 16, but the noble metal tips 38 and 38z and the holder 39 can have various other shapes. For example, the outer circumferential surface 384 of the noble metal tip 38 or 38z may vary stepwise in the forward direction Df. Also, the inner circumferential surface 394 of the holder 39 may vary stepwise in the forward direction Df. In either case, preferably, at least one of the outer circumferential surface 384 of the noble metal tip 38 or 38z and the inner circumferential surface 394 of the holder 39 have a taper surface whose diameter continuously reduces in the forward direction Df. Through employment of such a taper surface, even when at least one of the outside diameter of the noble metal tip 38 or 38z and the inside diameter of the holder 39 is large in tolerance, the noble metal tip 38 or 38z can be easily fitted into the through hole 395 of the holder 39. The outer circumferential surface 384 of the noble metal tip 38 or 38z can be easily brought into contact with the inner circumferential surface 394 of the holder 39.

In the embodiments of FIGS. 16 and 21, the protrusion 387 has an annular shape centered on the center axis CLx. However, the protrusion 387 may be provided only along an arc centered on the center axis CLx.

(2) The configuration of the fusion zone which joins the noble metal tip 38 or 38z and the holder 39 is not limited to those of the fusion zones 81, 81c, 82w, and 81v of the embodiments described above, but the fusion zone can have various other configurations. For example, the fusion zones 81, 81c, 82w, and 81v of FIGS. 3, 11, 20, and 22 may be disposed at such a position as not to be superposed on the longitudinal axis CLa of the body 33. In these cases, preferably, in order to restrain an increase in temperature of the noble metal tips 38 and 38z, at least one of the fusion zones is disposed on the side toward the proximal end 332 with respect to the center axis CLx of the noble metal tip 38 or 38z. Also, the fusion zones 81 and 81c may assume the form of a ring which surrounds the noble metal tip 38 along the entire circumference.

In these cases, the fusion zone which joins the holder 39 and the noble metal tip 38 or 38z may further join the body 33. Also, the fusion zone having an exposed surface exposed to the ambient atmosphere (e.g., an exposed surface exposed at the surface of at least one of the body 33 and the holder 39) joins the noble metal tip 38 or 38z and the holder 39 (e.g., the first fusion zone 81c of FIG. 12, the fusion zone 82w of FIG. 21, and the fusion zone 81v of FIG. 23). In this case, preferably, the content of components of the noble metal tip at the exposed surface is 20 wt. % or less. Employment of such a content can restrain oxidization of the fusion zone.

(3) The configuration of the fusion zone which joins the holder 39 and the body 33 is not limited to those of the first fusion zone 81c, the second fusion zone 82, and the fusion zones 82z, 82w, and 81v of the above-described embodiments, but the fusion zone can employ various other configurations. For example, as in the case of the fusion zones 81, 82w, and 81v of FIGS. 3, 11, 20, and 22, the fusion zones 82 and 82z of FIGS. 3 and 17 may assume the form of a plurality of fusion zones disposed away from one another along a circumferential direction. In this case, preferably, as in the case of the embodiments of FIGS. 11, 20, and 22, in order to restrain an increase in temperature of the noble metal tip 38 or 38z, at least one fusion zone is disposed on the side toward the proximal end 332 with respect to the center axis CLx of the noble metal tip 38 or 38z. Furthermore, preferably, in a view from a direction parallel to the center axis CLx of the noble metal tip 38 or 38z, at least one fusion zone is superposed on the longitudinal axis CLa of the body 33 while being located toward the proximal end 332 with respect to the center axis CLx. Also, in order to reduce the possibility of breakage of the holder 39 or the body 33 caused by thermal stress, a plurality of the fusion zones are disposed at such positions as not to be directly opposite one another with respect to the center axis CLx of the noble metal tip 38 or 38z.

(4) In the embodiments of FIGS. 3 and 11, the first fusion zones 81 may be eliminated except the first fusion zones 81 which are located on the side toward the proximal end 332 with respect to the center axis (herein, the center axis CL) of the noble metal tip 38. Also, in the embodiments of FIGS. 20 and 22, of the fusion zones 82w and 81v which are located on the side toward the proximal end direction Da with respect to the center axis CLx of the noble metal tips 38z and 38, some fusion zones 82w and 81v (e.g., the fusion zone 82wa of FIG. 20 and the fusion zone 81va of FIG. 22) may join only the body 33 and the holder 39 while being away from the noble metal tip 38z or 38.

Also, the fusion zones 82w and 81v of FIGS. 20 and 22 may be formed into the form of a ring centered on the center axis CLx. Preferably, the ring-like fusion zone is formed such that at least a portion of the half located toward the proximal end 332 with respect to the center axis CLx (on the side toward the proximal end direction Da) joins the body 33, the holder 39, and the noble metal tip 38 or 38z while the remaining portion (including the entire half located toward the distal end direction Db with respect to the center axis CLx) joins the body 33 and the holder 39 while being away from the noble metal tip 38 or 38z. In this manner, there may be formed continuously a fusion zone which joins the holder 39 and the noble metal tip 38 or 38z (furthermore, the body 33), and a fusion zone which joins the body 33 and the holder 39 while being away from the noble metal tip 38 or 38z. Such a configuration can enhance the effect of releasing heat from the noble metal tip 38 or 38z to the proximal end 332 through the body 33.

Generally, preferably, the entire fusion zone which joins at least the noble metal tip 38 or 38z and the holder 39 is located on the side toward the proximal end direction Da (toward the proximal end 332) with respect to the center axis CLx of the noble metal tip 38 or 38z, and at least a portion of the fusion zone which joins the holder 39 and the body 33 while being away from the noble metal tip 38 or 38z is located on the side toward the distal end direction Db (on the side opposite the proximal end 332) with respect to the center axis CLx. This configuration can restrain a positional shift of the noble metal tip 38 or 38z and can appropriately cool the noble metal tip 38 or 38z. Furthermore, even in the case where the noble metal tip 38 or 38z is lower in thermal expansion coefficient than the body 33, although the noble metal tip 38 or 38z is pulled in the proximal end direction Da by the fusion zone, the noble metal tip 38 or 38z is not pulled in the distal end direction Db. Therefore, breakage of the noble metal tip 38 or 38z can be restrained.

Preferably, in a view from a direction parallel to the center axis CLx of the noble metal tip 38z or 38, the fusion zone (e.g., the fusion zone 82wb of FIG. 20 and the fusion zone 81vb of FIG. 22) disposed at such a position as to be superposed on the longitudinal axis CLa of the body 33 while being located toward the proximal end 332 with respect to the center axis CLx of the noble metal tip 38z or 38 joins the body 33, the holder 39, and the noble metal tip 38*z* or 38. This configuration can appropriately cool the noble metal tip 38 or 38*z*.

(5) When the outside diameters Tf and Tr are to be determined from a completed spark plug, the fusion zone may cause difficulty in determining the contour of the noble metal tip 38. In such a case, the outside diameters Tf and Tr can be determined as follows: in a section which contains the center axis CLx of the noble metal tip 38, that portion of the contour of the noble metal tip 38 which is not included in the fusion zone is extended to obtain an imaginary contour. Similarly, the inside diameters Gf and Gr of the holder 39 can be determined by use of an imaginary contour of the holder 39. The center axis CLx of the noble metal tip 38 can be represented by a straight line which passes through the center (generally, the center of gravity) of the forward end surface 381 of the noble metal tip 38 in a direction perpendicular to the forward end surface 381. The position of the center of gravity of the forward end surface 381 is determined on the assumption that mass is evenly distributed in the forward end surface 381. The same is also applied to the outside diameters Tf and Trz of the noble metal tip 38*z*.

(6) The configuration of the ground electrode is not limited to those of the ground electrodes 30, 30*b*, 30*c*, 30*d*, 30*z*, 30*w*, and 30*v* of the above embodiments, but various other configurations can be employed. For example, the following configuration may be employed: the recess 335 of the body 33 is eliminated, and the noble metal tip 38 and the holder 39 are provided on the surface of the body 33. Also, in the above embodiments, the core 36 of the body 33 is disposed on the side toward the proximal end 332 with respect to the recess 335 or 335*z*. Additionally, the fusion zone (e.g., the second fusion zone 82 of FIG. 2) which joins the holder 39 and the body 33 is away from the core 36. Instead, the core 36 may be in contact with the fusion zone which joins the holder 39 and the body 33. Also, the core 36 may be omitted.

(7) The configuration of the spark plug is not limited to that described with reference to FIG. 1, but various other configurations can be employed. For example, the center electrode 20 may include a noble metal tip for forming the gap g. The noble metal tip can be formed of an alloy which contains a noble metal such as iridium or platinum. Also, the core 22 of the center electrode 20 may be eliminated.

The present invention has been described with reference to the above embodiments and modifications. However, the embodiments and modifications are meant to help understand the invention, but are not meant to limit the invention.

The present invention may be modified or improved without departing from the gist and the scope of the invention and encompasses equivalents of such modifications and improvements.

DESCRIPTION OF REFERENCE NUMERALS

5: gasket; 6: second packing; 7: third packing; 8: first packing; 9: talc; 10: insulator (ceramic insulator); 11: second outside-diameter reducing portion; 12: through hole (axial hole); 13: leg portion; 15: first outside-diameter reducing portion; 16: inside-diameter reducing portion; 17: first trunk portion; 18: second trunk portion; 19: collar portion; 20: electrode; 20: center electrode; 20*s*1: distal end surface; 21: electrode base metal; 22: core; 23: head portion; 24: collar portion; 25: leg portion; 30, 30*b*, 30*c*, 30*d*, 30*r*, 30*v*, 30*w*, 30*z*: ground electrode; 33, 33*x*: body; 35: base metal; 36: core; 38, 38*z*: noble metal tip; 38*p*1: first portion; 38*p*2: second portion; 39: holder; 40: metal terminal member; 41: cap attachment portion; 42: collar portion; 43: leg portion; 50: metallic shell; 51: tool engagement portion; 52: threaded portion; 53: crimped portion; 54: seat portion; 55: trunk portion; 56: inside-diameter reducing portion; 58: deformed portion; 59: through hole; 60: first seal; 70: resistor; 80: second seal; 81, 81*a*, 81*c*: first fusion zone; 81*cs*: exposed surface; 82: second fusion zone; 90, 90*n*, 90*p*, 90*z*: electrode tip; 93: boundary; 100, 100*v*, 100*w*, 100*z*: spark plug; 100*x*: assembly; 113*x*: load; 331: distal end portion; 332: proximal end; 334: through hole; 335, 335*z*: recess; 381: forward end surface; 384: outer circumferential surface (second taper surface); 384*e*: rearward end; 387: protrusion; 387*e*: end; 388: edge; 389, 389*z*: rearward end surface; 391: forward end surface; 392: edge; 393: outer circumferential surface; 394: inner circumferential surface (first taper surface); 395: through hole; 395*e*: edge; 398: edge; 399: rearward end surface; and g: gap.

Having described the invention, the following is claimed:

1. A spark plug comprising:

a ground electrode having a recess with a bottom surface formed therein;

a noble metal tip having an outer circumferential surface; and a holder having an inner circumferential surface defining a through hole, said through hole dimensioned to receive and surround the noble metal tip, the recess in said ground electrode being dimensioned to receive the noble metal tip and surrounding holder therein, and the holder being joined to a body of the ground electrode by laser welding with said noble metal tip held between a rearward end surface of the holder and the bottom surface of the recess; and a center electrode for forming a gap in cooperation with the noble metal tip, wherein Gf<Tr, Gf<Gr, and Tf<Tr where a forward side is a side toward the gap as viewed from the noble metal tip, Gf is an inside diameter of the holder at a forward end surface of the holder, Gr is an inside diameter of the holder at the rearward end surface of the holder, Tf is an outside diameter of the noble metal tip at a forward end surface of the noble metal tip, and Tr is an outside diameter of the noble metal tip at a rearward end surface of the noble metal tip;

at least one of a) the inner circumferential surface of the holder which forms the through hole, and b) the outer circumferential surface of the noble metal tip which is disposed in the through hole, continuously reduces in diameter toward the forward side; and the forward end surface of the noble metal tip is located on the forward side with respect to the forward end surface of the holder.

2. A spark plug according to claim 1, wherein the inner circumferential surface of the holder has a first taper surface which continuously reduces in diameter toward the forward side, and the outer circumferential surface of the noble metal tip has a second taper surface which continuously reduces in diameter toward the forward side.

3. A spark plug according to claim 2, wherein in a section of the noble metal tip which contains a center axis of the noble metal tip, a difference dAg obtained by subtracting a first angle Ag1 from a second angle Ag2 is from −10 degrees to +10 degrees, where the first angle Ag1 is an acute angle between the first taper surface and the center axis, and the second angle Ag2 is an acute angle between the second taper surface and the center axis.

4. A spark plug according to any one of claims 1 to 3, wherein the ground electrode further has a first fusion zone which joins at least the noble metal tip and the holder.

5. A spark plug according to claim 4, wherein the ground electrode has a plurality of the first fusion zones, and the first fusion zones are disposed at such positions as not to be directly opposite one another with respect to the center axis of the noble metal tip.

6. A spark plug according to claim 5, further comprising an insulator which holds the center electrode, and a metallic shell disposed radially around the insulator, wherein the body has a proximal end connected to the metallic shell, and at least one first fusion zone is located toward the proximal end with respect to the center axis of the noble metal tip.

7. A spark plug according to claim 6, wherein in a view from a direction parallel to the center axis of the noble metal tip, at least one first fusion zone is superposed on a longitudinal axis of the body while being located toward the proximal end with respect to the center axis.

8. A spark plug according to claim 5, wherein the first fusion zone has an exposed surface which is exposed at a surface of the body.

9. A spark plug according to claim 1, wherein the ground electrode has a second fusion zone which joins the holder and the body, and the second fusion zone is away from the noble metal tip.

10. A spark plug according to claim 9, wherein the ground electrode further has a first fusion zone which joins at least the noble metal tip and the holder;

the body has a proximal end connected to the metallic shell;

the entire first fusion zone is located toward the proximal end with respect to the center axis of the noble metal tip; and at least a portion of the second fusion zone is located opposite the proximal end with respect to the center axis of the noble metal tip.

11. A spark plug according to claim 9 or 10, wherein the noble metal tip has a protrusion which is connected to a rearward end of a portion disposed within the through hole and which protrudes radially outward from an edge of the through hole at the rearward end surface of the holder.

12. A spark plug according to claim 11, wherein the protrusion has a thickness of 0.2 mm or more along a direction parallel to the center axis of the noble metal tip.

13. A spark plug according to claim 12, wherein a length, along a radial direction of a circle centered on the center axis of the noble metal tip, between a rearward end of an outer circumferential surface of a portion of the noble metal tip disposed within the through hole and an outer circumferential end of the protrusion is from 0.05 mm to 0.25 mm.

14. A method of manufacturing a spark plug according to claim 1, comprising:

a disposition step of disposing the noble metal tip in the through hole of the holder; and a step of applying load to the holder from a radial direction of the holder after the disposition step.

15. A method of manufacturing a spark plug which has a ground electrode having a noble metal tip, a holder having a through hole for disposing therein the noble metal tip, and a body to which the holder is joined, and a center electrode for forming a gap in cooperation with the noble metal tip, comprising:

a disposition step of disposing the noble metal tip within the through hole of the holder; and a joining step of joining the holder to the body while the noble metal tip is disposed within the through hole of the holder, wherein $Gf<Tr$, $Gf<Gr$, and $Tf<Tr$ where a forward side is a side toward the gap as viewed from the noble metal tip, Gf is an inside diameter of the holder at a forward end surface of the holder, Gr is an inside diameter of the holder at a rearward end surface of the holder, Tf is an outside diameter of the noble metal tip at a forward end surface of the noble metal tip, and Tr is an outside diameter of the noble metal tip at a rearward end surface of the noble metal tip;

at least one of that inner circumferential surface of the holder which forms the through hole, and that outer circumferential surface of the noble metal tip which is disposed in the through hole, continuously reduces in diameter toward the forward side; and the forward end surface of the noble metal tip is located on the forward side with respect to the forward end surface of the holder in a state in which the noble metal tip is disposed in the through hole of the holder.

16. A method of manufacturing a spark plug according to claim 15, wherein the inner circumferential surface of the holder has a first taper surface which continuously reduces in diameter toward the forward side, and the outer circumferential surface of the noble metal tip has a second taper surface which continuously reduces in diameter toward the forward side.

17. A method of manufacturing a spark plug according to claim 16, wherein in that section of the holder and the noble metal tip disposed within the through hole of the holder which contains the center axis of the noble metal tip, a difference dAg obtained by subtracting a second angle Ag2 from a first angle Ag1 is from −10 degrees to +10 degrees, where the first angle Ag1 is an acute angle between the first taper surface and the center axis, and the second angle Ag2 is an acute angle between the second taper surface and the center axis.

18. A method of manufacturing a spark plug according to any one of claims 15 to 17, further comprising a forming step of forming a first fusion zone which joins the noble metal tip and the holder.

19. A method of manufacturing a spark plug according to claim 18, wherein the forming step includes a step of forming a plurality of the first fusion zones which are disposed at such positions as not to be directly opposite one another with respect to the center axis of the noble metal tip.

* * * * *